US007260914B2

(12) United States Patent
O'Connor

(10) Patent No.: US 7,260,914 B2
(45) Date of Patent: Aug. 28, 2007

(54) METHOD AND APPARATUS FOR PACKAGING HORTICULTURAL PRODUCTS

(75) Inventor: Jeremiah O'Connor, Waltham, MA (US)

(73) Assignee: Floral Transport Systems, LLC, Woburn, MA (US)

( * ) Notice: Subject to any disclaimer, the term of this patent is extended or adjusted under 35 U.S.C. 154(b) by 75 days.

(21) Appl. No.: 10/866,147

(22) Filed: Jun. 14, 2004

(65) Prior Publication Data

US 2005/0138861 A1 Jun. 30, 2005

Related U.S. Application Data

(60) Provisional application No. 60/533,021, filed on Dec. 27, 2003.

(51) Int. Cl.
*A47G 7/02* (2006.01)

(52) U.S. Cl. ..... 47/41.01; 47/41.12

(58) Field of Classification Search ..... 47/41.01, 47/41.1, 41.11, 41.12, 41.13, 41.14, 41.15
See application file for complete search history.

(56) References Cited

U.S. PATENT DOCUMENTS

| | | | | |
|---|---|---|---|---|
| 2,453,906 | A | 11/1948 | Hamlet | |
| 3,003,284 | A * | 10/1961 | Smithers | 47/41.12 |
| 3,245,175 | A * | 4/1966 | Klingberg | 47/41.13 |
| 3,374,575 | A * | 3/1968 | Tong | 47/41.12 |
| 3,651,601 | A * | 3/1972 | La Montagne | 47/41.12 |
| 3,812,619 | A * | 5/1974 | Wood et al. | 47/58.1 R |
| 3,899,850 | A * | 8/1975 | Gluck et al. | 47/74 |
| 3,961,445 | A * | 6/1976 | Rack | 47/74 |
| 3,973,355 | A * | 8/1976 | McKenzie | 47/59 R |
| 4,858,381 | A | 8/1989 | Walton et al. | |
| 4,908,986 | A * | 3/1990 | Rowland et al. | 47/80 |
| 4,936,046 | A | 6/1990 | Miller | |
| 4,941,572 | A * | 7/1990 | Harris | 206/423 |
| 5,006,569 | A * | 4/1991 | Stone | 521/118 |
| 5,043,196 | A * | 8/1991 | Lacourse et al. | 428/35.6 |
| 5,103,586 | A * | 4/1992 | Farrell | 47/41.12 |
| 5,115,915 | A | 5/1992 | Harris | |
| 5,130,152 | A | 7/1992 | Alameda | |
| 5,135,771 | A | 8/1992 | Chackal | |

(Continued)

FOREIGN PATENT DOCUMENTS

EP 0241341 * 10/1987

(Continued)

OTHER PUBLICATIONS

Ruey Lung Rubber Co. Ltd. "EVA Foam/PE Properties Table", 2006 [retrieved Jun. 12, 2006]. Retrieved from teh internet: <URL:http://www.rueylung.com.tw/products/EVA_Foam/eva_pe_ees>.*

*Primary Examiner*—David Parsley
(74) *Attorney, Agent, or Firm*—DLA Piper US LLP

(57) ABSTRACT

In a method and apparatus for packaging a horticultural product, especially cut flowers, for transportation, one or more stems are inserted through a flexible foam block formed from a low density, low compression force material disposed in an opening of container such that the foam is compressed. The compression of the foam forms a water-tight seal around each stem to prevent water or other liquid inside the container from leaking during shipment of the horticultural product and insulates each stem from each other stem.

78 Claims, 16 Drawing Sheets

U.S. PATENT DOCUMENTS

| | | | | | |
|---|---|---|---|---|---|
| 5,142,820 | A | | 9/1992 | Aquino | |
| 5,155,931 | A | * | 10/1992 | Vansteenkiste et al. | 47/64 |
| 5,181,364 | A | | 1/1993 | Weder | |
| 5,205,108 | A | | 4/1993 | Weder et al. | |
| 5,224,598 | A | | 7/1993 | Angeles et al. | |
| 5,311,991 | A | | 5/1994 | Weder et al. | |
| 5,315,782 | A | * | 5/1994 | Barclay et al. | 47/41.12 |
| 5,373,943 | A | | 12/1994 | Weder et al. | |
| 5,402,599 | A | | 4/1995 | Weder et al. | |
| 5,469,654 | A | | 11/1995 | Thompson | |
| 5,497,577 | A | | 3/1996 | Carpenter | |
| 5,501,059 | A | | 3/1996 | Weder et al. | |
| 5,515,644 | A | | 5/1996 | Weder et al. | |
| 5,564,255 | A | | 10/1996 | Giacomelli | |
| 5,572,826 | A | * | 11/1996 | Weder | 47/41.12 |
| 5,615,532 | A | | 4/1997 | Weder et al. | |
| 5,640,805 | A | * | 6/1997 | Weder | 47/72 |
| 5,890,343 | A | | 4/1999 | Weder et al. | |
| 5,927,002 | A | | 7/1999 | Walton et al. | |
| 5,970,654 | A | | 10/1999 | Skinner | |
| 6,100,359 | A | * | 8/2000 | Ghatan | 528/51 |
| 6,101,789 | A | | 8/2000 | Weder et al. | |
| 6,138,828 | A | | 10/2000 | Bendix | |
| 6,145,245 | A | * | 11/2000 | Honkawa et al. | 47/41.01 |
| 6,167,688 | B1 | | 1/2001 | Umeoka | |
| 6,185,863 | B1 | | 2/2001 | Tabbert | |
| 6,269,611 | B1 | * | 8/2001 | Weder et al. | 53/399 |
| 6,393,762 | B1 | * | 5/2002 | Harshman et al. | 47/41.12 |
| 6,463,397 | B1 | | 10/2002 | Cohen et al. | |
| 6,591,550 | B2 | | 7/2003 | Gilbert | |
| 6,604,632 | B2 | | 8/2003 | Weder | |
| 6,672,002 | B1 | | 1/2004 | Gumpper | |
| 6,691,456 | B2 | | 2/2004 | Vahrmeyer | |
| 6,918,207 | B2 | * | 7/2005 | Dai | 47/81 |
| 2001/0035364 | A1 | | 11/2001 | Weder et al. | |
| 2002/0174601 | A1 | * | 11/2002 | Weder et al. | 47/72 |
| 2002/0189963 | A1 | | 12/2002 | Weder et al. | |
| 2002/0195365 | A1 | | 12/2002 | Weder | |
| 2003/0089080 | A1 | | 5/2003 | Weder, et al. | |
| 2003/0136089 | A1 | | 7/2003 | Weder | |
| 2003/0173246 | A1 | | 9/2003 | Weder et al. | |
| 2004/0244285 | A1 | * | 12/2004 | Fishman et al. | 47/41.11 |
| 2004/0253410 | A1 | * | 12/2004 | Higgins et al. | 428/96 |
| 2004/0259966 | A1 | * | 12/2004 | Lovette | 521/82 |

FOREIGN PATENT DOCUMENTS

| | | | |
|---|---|---|---|
| FR | 2732548 | * | 10/1996 |
| GB | 2086222 | * | 5/1982 |
| GB | 2093436 | * | 9/1982 |
| GB | 2147205 | * | 5/1985 |
| JP | 1-320939 | * | 12/1989 |
| JP | 4-126018 | * | 4/1992 |
| JP | 4-360624 | * | 12/1992 |
| JP | 5-193687 | * | 8/1993 |
| JP | 6-46670 | * | 2/1994 |
| JP | 7-52985 | * | 2/1995 |
| JP | 8-172910 | * | 7/1996 |
| JP | 8-172911 | * | 7/1996 |
| JP | 11-75545 | * | 3/1999 |
| JP | 2003-250344 | * | 9/2003 |

* cited by examiner

METHOD AND APPARATUS FOR PACKAGING HORTICULTURAL PRODUCTS

This application claims priority from U.S. Provisional Application Ser. No. 60/533,021, entitled "Device For Shipment of Horticultural Products," filed Dec. 27, 2003. The entirety of that provisional application is incorporated herein by reference.

BACKGROUND OF THE INVENTION

1. Field of the Invention

The invention relates generally to horticultural products, and more particularly to a method and apparatus for packaging horticultural products such as cut flowers.

2. Discussion of the Background

The market for horticultural products, particularly cut flowers, is large and continues to grow. In this industry, it is important that the horticultural product be fresh when it is presented to a consumer. The freshness of the horticultural product will determine both (1) how the product initially appears to the consumer, and (2) how long the product will last for the consumer. The product's initial appearance is particularly important in a retail setting such as a cut flower display in a store because consumers will often base their purchasing decision on the initial appearance. However, initial appearance is also important when pre-paid flowers are delivered to a consumer. How long the flowers last is also an important part of customer satisfaction—most customers will not be happy with flowers that wilt the day after they are received no matter how nice they looked the previous day.

The manner in which horticultural products are shipped plays an important role in both the initial appearance of the horticultural product and how long the horticultural product will last. Today, cut flowers are typically shipped from a grower by airfreight without water. Then they are either repackaged into an upstanding, open box with 1"–2" of water on the bottom such that the ends of the stems can take up water to keep the flowers fresh, or they continue through distribution without water. With either method, the flowers are typically refrigerated to preserve their freshness. Both of these methods have obvious drawbacks. Shipping the flowers dry reduces their life no matter how well they are refrigerated. Shipping the flowers in an open container partially filled with water requires that the containers not be overturned during shipping, which increases shipping costs and distribution time.

Some attempts to provide a device that will allow flowers to be shipped such that their stems are in water have been disclosed in the patent literature. However, each of these alternative devices has drawbacks and, to the knowledge of the inventor, none of the alternative devices has met with any commercial success.

U.S. Pat. No. 2,453,906 to Hamlet discloses a device including tubular container with a "stopper" made in whole or in part from a "resilient material" inserted into each end. The stopper in the top end of the tubular container includes a bore sized to give an air-tight fit around a stem. The stopper is of a size to make it fit hermetically in the top end of the tube. The bottom end of the tube also has a stopper with a bore formed therein. The bottom end also includes a flexible diaphragm that stretches to fill the void created when water is taken up by a stem.

This device has several drawbacks. First, the requirement for the flexible diaphragm increases the packaging cost. Second, the "resilient material" illustrated in the '906 patent does not appear to be very resilient. The drawings show very little deformation of the material in areas where it is fitted into the tube. Given the issue date of the '906 patent in 1945, it is very likely that the "resilient material" is rubber. The problem with a material of such a resiliency is that it requires a relatively close match between the size of the bore in the stopper and the diameter of a plant stem inserted therein. Plant stem diameters can vary from as little as ⅛ inch to as much as ⅝ inch or greater. Thus, it is necessary to either make the bore to a specific size to match a particular stem, or provide a plurality of stoppers with different sized bores to accommodate cut flowers of different sizes.

This is not a practical alternative for two reasons. First, flower stems are not regularly shaped and often have protrusions (e.g., rose stems have protrusions where thorns are removed). It would be necessary to size the bore to accept any protrusion or other irregularity. However, considering the relatively inflexible material of '906 patent, the walls of bore may not contact the stem in areas other than the location of the protrusion or irregularity, resulting in a poor seal. Second, a requirement for matching stem sizes to bore sizes would be time-consuming, and therefore expensive, in a mass-production environment. This would be especially true in an automated mass-production environment in which thousands of flowers are packaged because stems would need to be measured, sorted and staged for insertion into pre-arranged stoppers of the correct size.

U.S. Pat. No. 5,315,782 describes a device including a flexible walled pouch filled with a "moisturized gel" of a "fluid paste consistency" (col. 2, lines 46–66). The top end of the pouch includes a "puncturable insert" made from a closed cell foam plastics material such as a "medium density polyethylene foam sold under the trade name JIFFYCELL." Applicants believe this is a rigid foam of the type that is commonly green in color and used in floral arrangements. The edges of the bag are adhered to this foam, and no compression of the foam is disclosed. The '782 patent teaches forming a hole for a plant stem in the foam insert by pushing a sharpened pencil through the foam.

The most significant drawback associated with the '782 patent is that it does not form a good seal around the stem. The '782 patent recognizes this when it states that "the tendency to leak is reduced by that fact that it is a gel material" in the pouch (col. 3, lines 49–50). If the seal around the stem were good, then it would not be necessary to use a "gel" rather than water. The poor seal is caused by the lack of compression and the use of a rigid foam. Another drawback associated with the '782 device is that, because the foam is relatively rigid, it is again necessary to size the hole to the stem that is to be inserted therein.

U.S. Pat. No. 5,103,586 discloses a device including a rigid cup-shaped container, a first layer comprised of rigid foam, a second layer of a "penetrable elastomeric sealing elastomer . . . chosen to be sufficiently elastic to flow at about room temperature," and an optional third layer also comprised of a rigid foam. The sealing elastomer is preferably an RTV silicone rubber made from a two part liquid silicone that cures into the desired flowable sealing elastomer. The chief drawbacks associated with this device are the cost associated with using multiple layers and the time required for the elastomer to cure.

U.S. Pat. Nos. 4,941,572 and 5,115,915 to Harris disclose a device comprising a rigid container with a non-absorbent foam block that is either preformed of a rigid foam material adhered to the container or formed from a foamed-in-place foam dispensed from an aerosol container. Col. 6, lns 43–58. The preformed block embodiment of this device suffers from the drawbacks of having to use an adhesive to secure the block to the container and, because the foam is rigid, the need for sizing holes in the block to match the stems. The foam-in-place embodiment suffers from the high cost associated with aerosol foams, and requires something to hold the stems in place while the foam is introduced.

SUMMARY OF THE INVENTION

The aforementioned issues are addressed to a great extent by the present invention, which provides a method and apparatus for packaging a horticultural product, especially cut flowers, in which one or more stems are inserted through a flexible foam block formed from a low density, low CFD (compression force/deflection) material disposed in an opening of container such that the foam is compressed. The compression of the foam insulates each stem and forms a water-tight seal around each stem to prevent water or other liquid inside the container from leaking during shipment of the horticultural product.

In some embodiments of the invention, the foam block is cut from a solid piece of foam or is molded to a desired shape. In other embodiments, the foam block is formed by rolling up a strip of foam that includes a plurality of V-shaped channels formed therein. In some embodiments of the invention, the container is rigid. In other embodiments, the container is flexible.

In one aspect of the invention, the use of compression provides a significant advantage as compared to prior art devices in that it allows flower stems to be tightly packed during shipping. This reduces the amount of space required by an individual bouquet of flowers. Reducing space during shipping is very important for large-scale commercial operations in which multiple bouquets are shipped in a single package.

BRIEF DESCRIPTION OF THE DRAWINGS

The aforementioned advantages and features of the present invention will be more readily understood with reference to the following detailed description and the accompanying drawings in which.

DETAILED DESCRIPTION

Figure 1A:
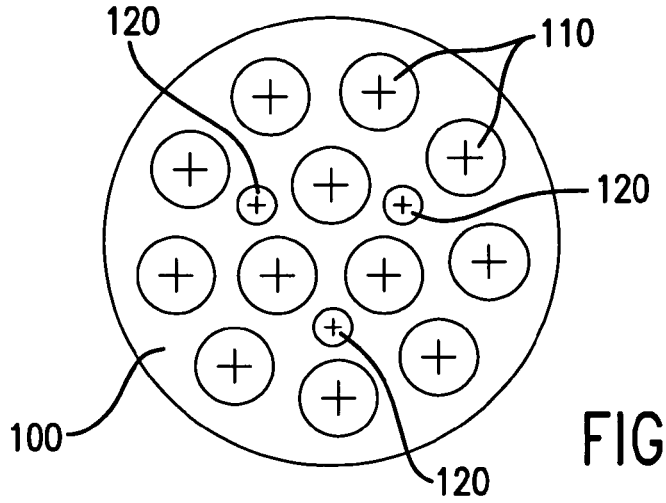
FIG. 1*a* is a top view of a foam block according to one embodiment of the invention in an uncompressed state.

In the following detailed description, a plurality of specific details, such as types of foam and amounts of compression, are set forth in order to provide a thorough understanding of the present invention. The details discussed in connection with the preferred embodiments should not be understood to limit the present invention. Furthermore, for ease of understanding, certain method steps are delineated as separate steps; however, these steps should not be construed as necessarily distinct nor order dependent in their performance.

The invention is believed to have particular utility for the packaging of cut flowers for transportation and hence will be discussed primarily in that context herein. The invention should not be understood to be so limited and should be understood to be useful for packaging horticultural products for other purposes (e.g., display in a retail setting) and should also be understood to be useful with other horticultural products such as potted plants as well as other non-horticultural products having regular or irregular cross sections in the range of typical plant stems as described herein.

It has been discovered that the properties of the foam used in the foam block are very important to achieving a satisfactory seal around a plant stem. In particular, it has been discovered that a foam with a combination of low density and low CFD (compression force/deflection, which is a measure of the compressability, or softness, of the foam) is particularly well suited for the invention. Foams with densities between about 0.5 and 10 pounds per cubic foot (according to the ASTM-D-1667 method) and a CFD between about 0.5 and 10 psi (according to the ASTM-D-1056 method) are preferred. By way of comparison, a rubber stopper, which is believed to be the material used in the above-discussed '906 patent to Hamlet, has a density on the order of 15–20 pounds per cubic foot and a CFD much higher than 10 psi.

Within the above-mentioned guidelines, there are several types of foams that are believed to be suitable for practicing the invention depending on the expected fluctuation in temperature and elevation within a given distribution scenario, including: elastomeric foams (which includes natural rubber-based foams, and synthetic rubber-based foams including EDPM and nitrile rubber based foams and blends thereof with vinyl, PVC, and EVA), polyethylene foams (including cross-linked polyethylene foams), and polyurethane foams. One foam that has been found to provide a good seal in the context of the invention is a vinyl nitrile foam sold under the name SBE-41 Vinyl Nitrile 4, product designation F-06721. This foam is a nitrile rubber/polyvinyl chloride blend with a density of 4 $lb/ft^3 \pm 0.7$ $lb/ft^3$ and a CFD of 3.5 psi±1.5 psi. It carries a 2Cl rating and has been combustion-modified to meet the standards set forth in UL 94HF-1 and FMVSS-302. Another foam believed to be suitable for use with the present invention is a cross-linked polyethylene foam sold under the mark Voltex MM200.

Because the foam block is used to form a watertight seal, closed cell foams are used in preferred embodiments of the invention. However, it is also possible to practice the invention using an open cell foam provided that the open cell foam is sufficiently compressed to form a watertight seal (the amount of compression used with an open cell foam will generally be higher than with a closed cell foam). An example of an open cell foam believed to be suitable for use with the present invention is Low Perm polyurethane foam. Generally, an open cell foam must be compressed by at least 40% in order for it to act as a closed cell foam. Thus, when used in the context of the present invention, such open cell foams must be compressed by 40% plus an additional amount commensurate with the amounts discussed below, which are relevant to closed cell foams.

Figure 1B:
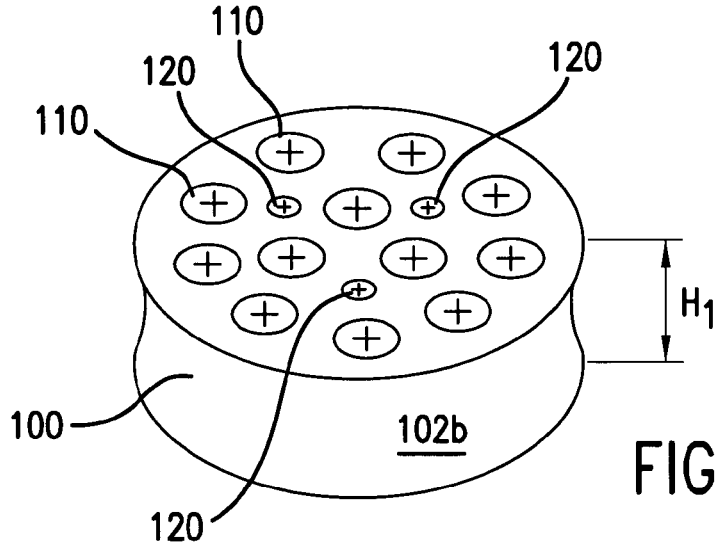
FIG. 1*b* is a perspective view of the foam block of FIG. 1*a* in an embodiment of the invention in which the foam block is die-cut from a larger piece of foam.
Figure 1C:
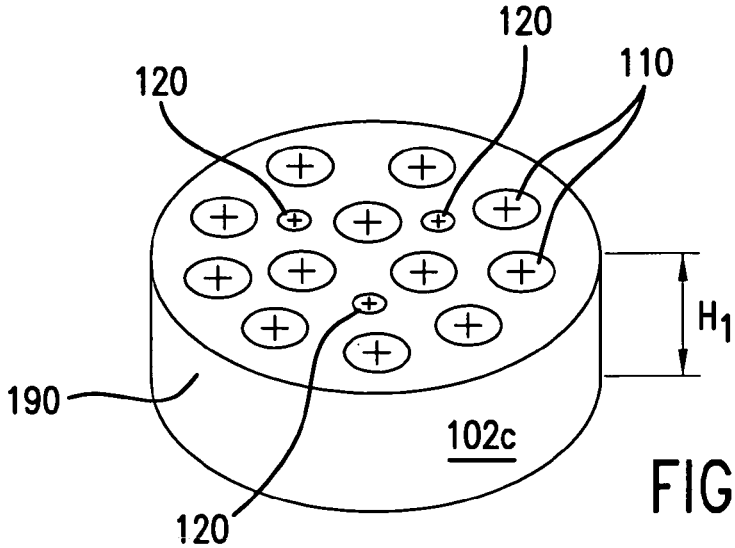
FIG. 1*c* is a perspective view of the foam block of FIG. 1*a* in an embodiment of the invention in which the foam block is molded.

In some embodiments of the invention, a foam block 100 is die-cut from a solid piece of foam in the shape shown in FIGS. 1*a* and 1*b*. The foam block 100 preferably includes one or more holes 110 for receiving the stems of cut flowers such as roses. The foam block 100 of FIG. 1 includes 12 holes (as roses are typically sold by the dozen) 110, but the number of holes can be more or less as desired. The holes 110 preferably range from about ¼" to about ⅜" in diameter. For example, in embodiments of the invention in which the stem sizes range from ⅛" to ⅝" and the vinyl nitrile foam discussed above is used for the block 100, the size of the holes is ⅜" when stems are inserted into the holes 110 without stretching the holes 110 prior to insertion of the stems. In embodiments in which fulfillment equipment (discussed in further detail below) is used to stretch the holes 110 prior to insertion of the stems, the hole size is ¼". The foam block 100 also includes three smaller holes 120 with diameters of 3/16". The smaller holes 120 are provided to accept greens (e.g., baby's breath) that accompany the bouquet of cut flowers in the holes 110. As with the holes 110, the number of smaller holes 120 can vary and, in some embodiments, no smaller holes 120 are provided. The holes 110 and 120 are typically spaced apart from other neighboring holes 110, 120 by 5/32" to ½", depending on stem size and the softness of the stems (generally, the more soft the stem is, the more room between stems is necessary).

Referring now back to FIG. 1(*b*), it can be seen that the vertical wall 102*b* of the foam block 100 is concave. This is as a result of the die cut process by which the foam block 102 is formed. This shape is advantageous in that it provides a somewhat more secure mechanical bond when used with a band such as the band 320 described below. It should be understood that the invention is not so limited and that other embodiments of the invention employ foam blocks with non-concave surfaces, such as the foam block 190 illustrated in FIG. 1(*c*) which includes a straight side wall 102*c*. The foam block 190 may be formed by molding rather than die-cutting from a pre-formed piece of foam.

Figure 2A:
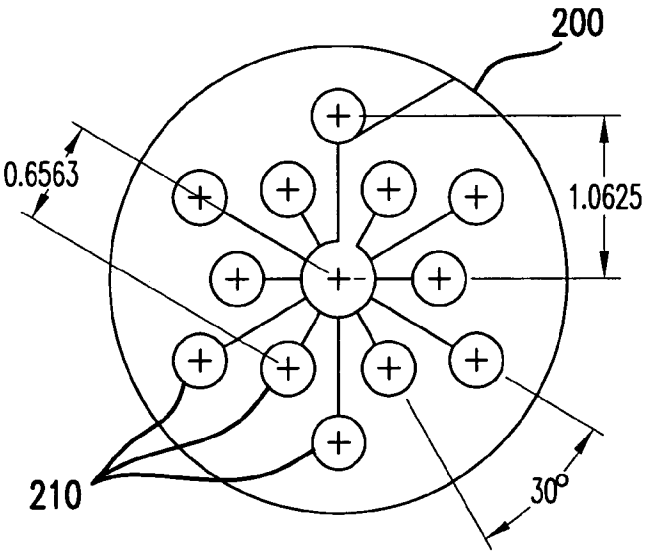
FIGS. 2*a* and 2*b* are top views of a non-integral foam block in rolled (uncompressed) and unrolled positions, respectively, according to a second embodiment of the invention.
Figure 2B:
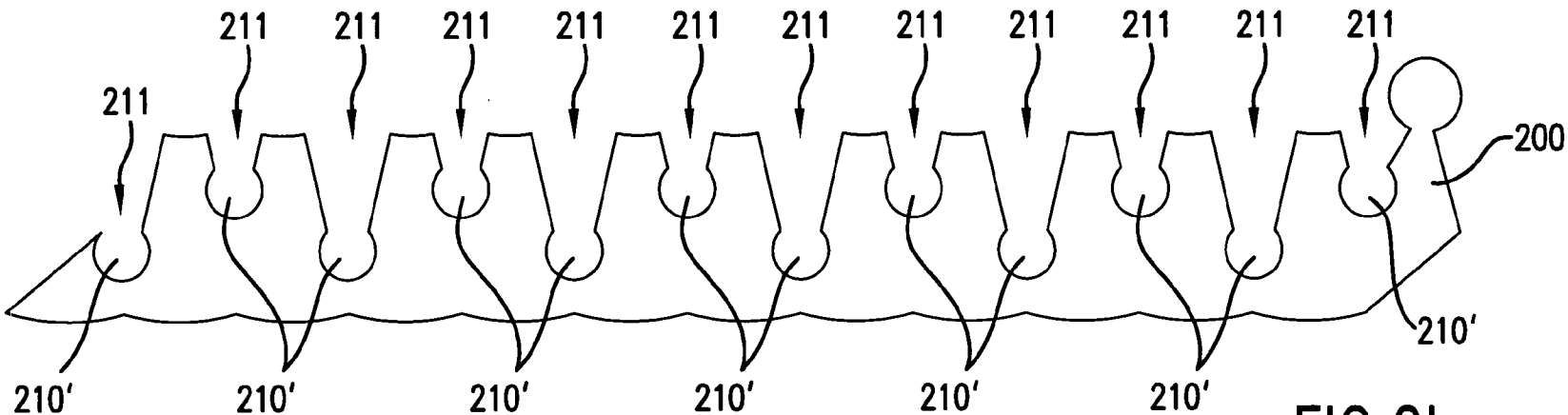

The foam blocks 100, 190 of FIG. 1 are integrally formed. An alternative foam block 200 is illustrated in FIGS. 2*a* and 2*b*. FIG. 2*a* is a top view of the block 200 rolled up into a cylindrical form. In this configuration, the block 200 includes a plurality of holes 210, each preferably having the same ⅜" diameter as the holes 100 of FIG. 1*a*. As shown in FIG. 2*b*, the block 200 is comprised of a length of foam having a plurality of channels 211 that terminate in partially circular portions 210'. When the length of foam is rolled up, the opposite walls of the channels 211 are in contact with each other leaving no space between them, and the partially circular portions 210' are closed to form the holes 210.

The foam blocks 100, 190, 200 illustrated above in FIGS. 1 and 2 each have circular cross sectional shapes. However, the invention may be practiced with foam blocks of different shapes (e.g., square, oval, etc.). The foam blocks 100, 190, 200 of FIGS. 1 and 2 preferably have a height $H_1$ of approximately one to two inches. However, in other embodiments, the heights of the foam blocks may be as short as one half of an inch or may be as tall as is desired, subject to the length of the stems and the container with which the foam block is used.

Figure 3:
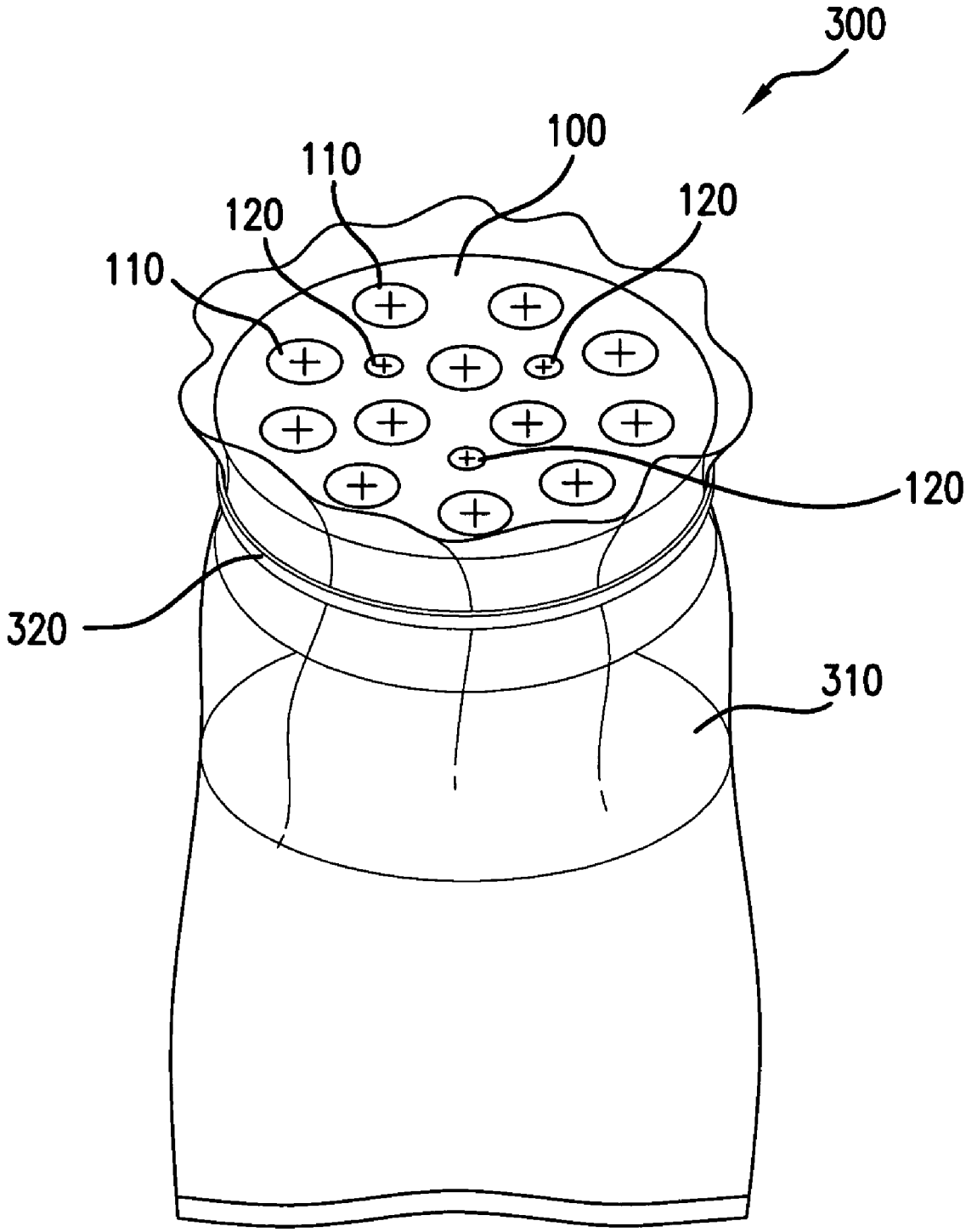
FIG. 3 is a perspective view of a shipping assembly employing a foam block and a flexible container (shown prior to compression of the foam block) according to a third embodiment of the invention.

FIG. 3 illustrates a packaged horticultural product 300 according to an embodiment of the invention. The product 300 includes the foam block 100 of FIGS. 1*a*, 1*b*, but is should be understood that either the foam block 190 of FIG. 1*c* or the foam block 200 of FIG. 2 could be used in its place. The foam block 100 is disposed in the opening of a container in the form of a flexible bag 310. The bag 310 of FIG. 3 is plastic, but rubber, latex or any other suitable material may be used in other-embodiments. A band 320 is used to compress the bag 310 and the foam block 100 (which is shown prior to compression in FIG. 3) so that a watertight seal is formed between the foam block 100 and the bag 320, and between the foam block 100 and stems (not shown in FIG. 3) disposed in the holes 110, 120 of the foam block 100. The band 320 may be formed of any suitable material, and comprises a cable tie or nylon strapping in preferred embodiments of the invention. Such ties typically have a width of approximately ⅛"–1.5".

Compressing the foam block 100 (again, shown prior to compression in FIG. 3) is critical to making the product 300 watertight so that liquid inside the bag 310 does not escape during shipping regardless of the orientation of the product 300. The foam block 100 of FIGS. 1*a* and 1*b* should be compressed by an amount of at least 15% when included in the product 300 to ensure that a watertight seal is formed. Preferably, the amount of compression is in the range of 20%–60%, and more preferably in the range of 25%–55%. The aforementioned compression values should be understood to mean that the diameter of a circular foam block with one or more stems inserted therethrough has been reduced by the amount of the compression when the compressive force is applied diametrically around the circumference of the foam block. Thus, for example, if the diameter of the foam block 100 is 2.25" prior to compression, compressing the foam block by 20% means that the foam block is compressed such that its diameter is reduced by 2.25"*0.20=0.45". The diameter of such a foam block will be 2.25"–0.45"=1.8" when the block is compressed by 20%.

The above-stated compression values can also be expressed as a reduction in cross-sectional area of the foam block in a plane corresponding to the direction in which the compressive force is applied. For example, compressing the block such that its diameter is reduced by 20% will reduce the cross sectional area by approximately 36%. When expressed in this fashion, the aforementioned compression ranges correspond to reducing the cross-sectional area by at least 28%, preferably between 36% and 84%, and more preferably still between 56% and 80%. The foregoing reductions in cross sectional areas are applicable to circular blocks as well as non-circular blocks.

The aforementioned values reduction in cross-sectional area do not include the effect of stems in the block, which do not compress. In a typical embodiment, a 2.25" foam block includes a bouquet of a dozen roses with a stem size of 0.25." The area of such a foam block is 3.976 square inches (assuming the holes for the stems are also 0.25"), and the area of the stems is 0.589 square inches. Thus, the area of the foam in the foam block is 3.976–0.589=3.38 square inches. When the area of the block (including the stems and the foam) is reduced by 28%, its new area is 2.86." Because the stems do not compress, the area of the foam in the compressed block is 2.86"–0.589"=2.27." Thus, the foam in the block has been compressed from an area of 3.38" to 2.27", which is 2.27/3.38=0.67 or 67% of its original area, a reduction of 33%. Thus, a 28% reduction in cross sectional area of a 2.25" inch block that includes a dozen stems with a diameter of a quarter inch translates to a 33% reduction in cross sectional area of the foam itself. The corresponding ranges of 36%–84% and 56%–80% translate to 42%–98.7% and 66%–89%.

The use of a low density, low CFD foam compressed in the amounts specified herein provides a water-tight seal without requiring the use of an adhesive or a sealer around the foam block, which saves time and money. The use of a low density, low CFD foam also allows use of the product 300 with plain water disposed within the bag 310. This is an important improvement over techniques employed in some conventional applications (e.g., U.S. Pat. No. 2,453,906) that depend upon using a thicker fluid such as a gel rather than water to hydrate the plant in order to ensure that leaks do not occur. However, the foregoing should not be understood to limit the invention to use with water. Rather, it should be understood that the present invention is not limited to use with water and may be used with liquids of various viscosities, including liquids with viscosities approximately equal to that of water as well as liquids such as gels with higher viscosities. Such liquids may or may not contain plant nutrients or other substances.

Figure 4:
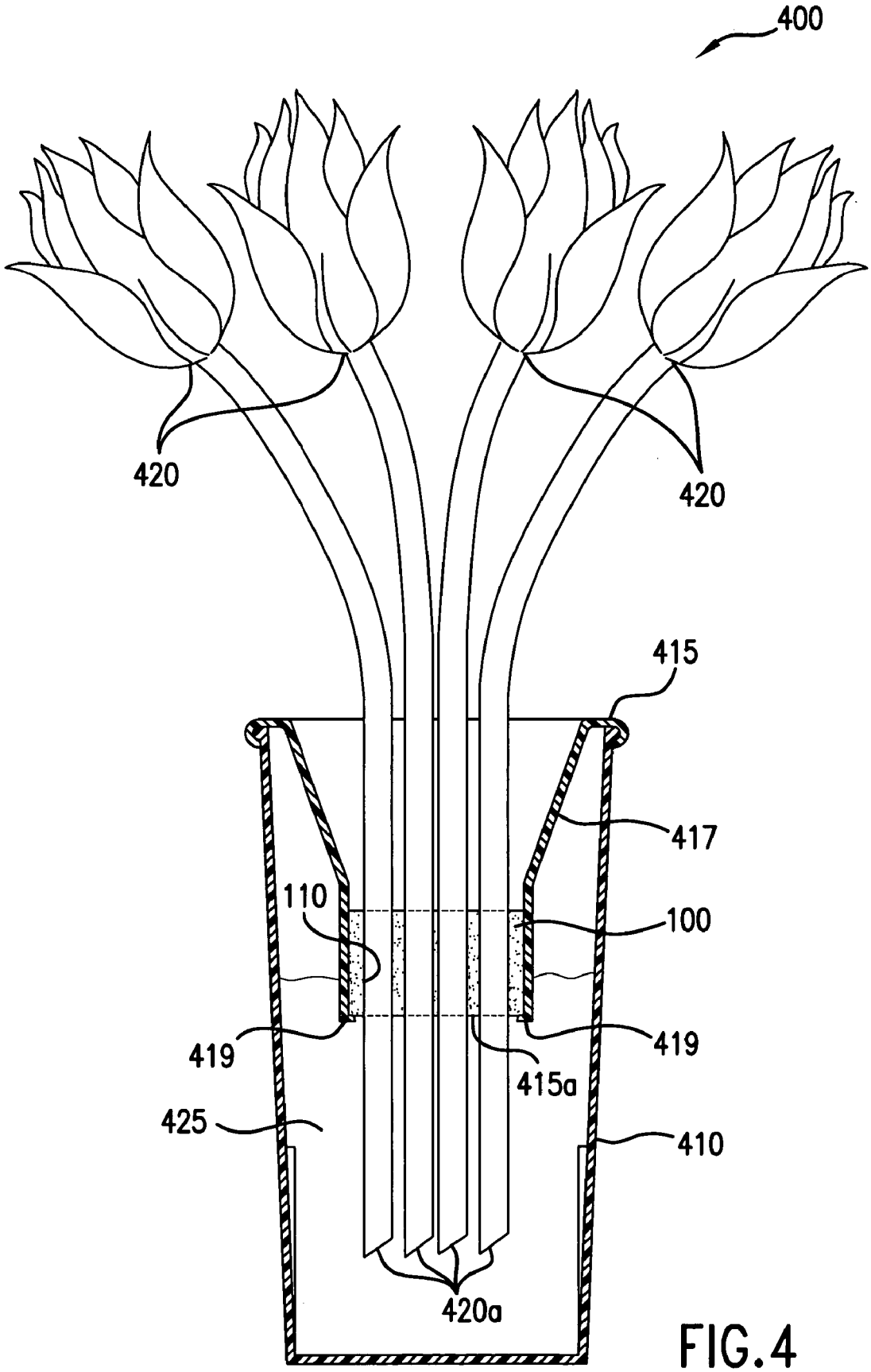
FIG. 4 is a side cross-sectional view of a shipping assembly employing a foam block and a rigid container according to a fourth embodiment of the invention.

FIG. 4 illustrates a packaged horticultural product 400 according to another embodiment of the present invention. The product 400 includes a plurality of flowers 420, each having a stem 420*a* inserted into a respective hole 110 of foam block 100. As with the product 300 discussed above, foam block 190 or foam block 200 may be used in place of the foam block 100. Foam block 100 is disposed in a container 410, which is preferably made from plastic and is partially filled with a liquid 425.

Figure 5A:
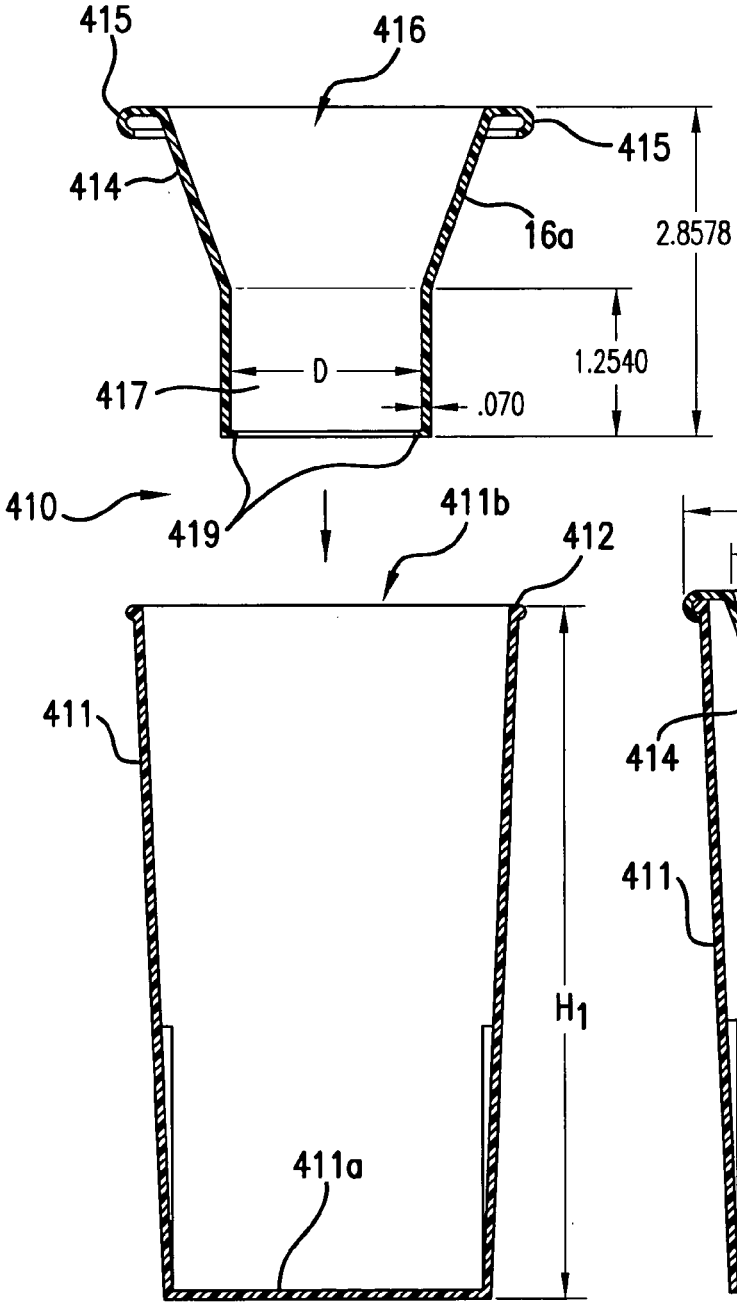
FIGS. 5*a* and 5*b* are exploded and assembled side cross sectional views, respectively, of the shipping assembly of FIG. 4.
Figure 5B:
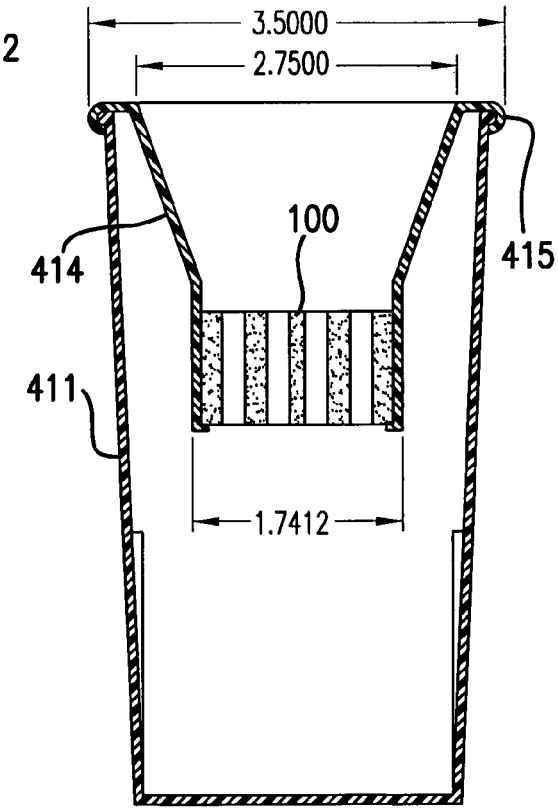

The container 410 is illustrated in greater detail in FIGS. 5*a* and 5*b*. The container 410 includes a generally frusto-conical lower portion 411 of height $H_1$ with a closed bottom 411*a* and an open top 411*b*. A ridge 412 is formed around the open top 411*b*. A cap 414 is placed on the open top 411*b*. The cap 414 includes a lip 415 that mates with the ridge 412 on the lower portion 411 such that a watertight seal is formed when the cap 414 is pressed onto the lower portion 411. The mechanical bond formed by the ridge 412 and lip 415 must be sufficiently strong such that the cap 414 will not become separated from the lower portion 411 during transportation of the product 400.

The cap 414 includes a funnel shaped portion 416 and a generally cylindrical portion 417. The cylindrical portion 417 includes a lower lip 419. The lower lip 419 functions to retain the foam block 100 as illustrated in FIG. 5*b*. The cylindrical portion has a diameter D sized such that the foam block is compressed by an amount in the ranges discussed above. When the foam block is compressed in this range, a watertight seal is formed between the foam block and the stems 420*a* and the interior surface of the wall of the cylindrical portion 417 such that water or other fluid in the lower portion 411 of the container 410 will not leak regardless of the orientation of the product 400.

In practice, it is preferable to insert the stems 420*a* into the foam block 100 first, next place the foam block 100 into the cylindrical portion 417 of the cap 414, and then place the cap 414 on the lower portion 411. The amount of air that is trapped and compressed in the lower portion 411 as a result of fitting the product 400 together in this manner is less than if the foam block 100 and stems 420 were fitted into the cap 414 after it was in place on the lower portion 411. Keeping back pressure low can be important when the product is shipped by air in a partially or wholly de-pressurized cargo hold at high altitudes.

Figure 6A:
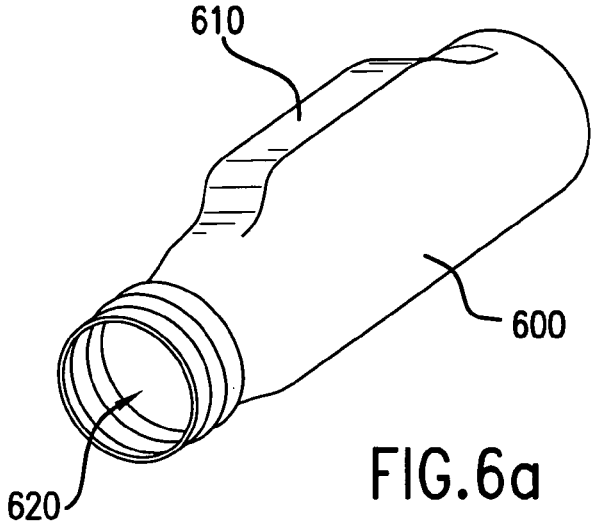
FIGS. 6*a*, 6*b* and 6*c* are perspective, side and side views, respectively, of a container for use in a shipping assembly according to a fifth embodiment of the invention.
Figure 6B:
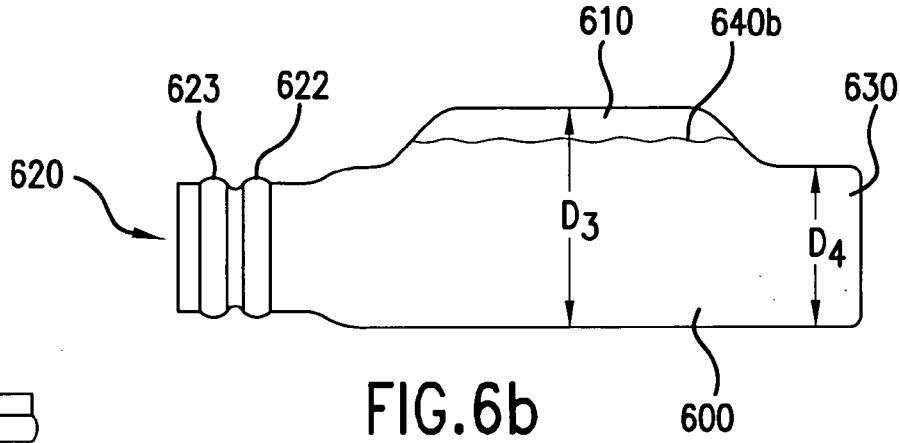
Figure 6C:
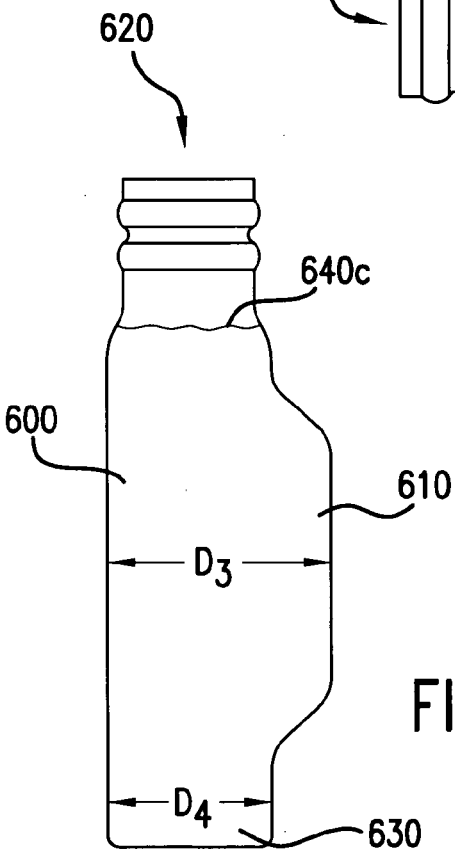

A container 600 for use in a packaged horticultural product according to yet another embodiment of the invention is illustrated in FIGS. 6*a* and 6*b*. The container 600, which is again preferably formed from a flexible material such as plastic, has an open top 620 and a closed bottom 630. A protrusion 610 is formed on one side of the container 600 such that the diameter $D_3$ of the container 600 is wider in the area of the protrusion 610 than the diameter $D_4$ of the bottom end 630 of the container 600. The protrusion adds to the volume of water that the container 600 can hold. When the container is filled with a liquid to a level 640*c* near the top as shown in FIG. 6*c*, and is then laid on its side as shown in FIG. 6*b*, the water level 640*b* extends at least partially into the protrusion 610 such that the bottom 630 remains filled with liquid (provided that something is disposed within the open top 620 to prevent the liquid from escaping). This ensures that any stems disposed within the container 600 remain submerged in the liquid when the container 600 is laid on its side. In contrast, the liquid level in a container without the protrusion 610 would drop far lower when placed in its side, which would likely result in one or more stems being situated above the liquid level rather than remaining submerged.

Figure 7:
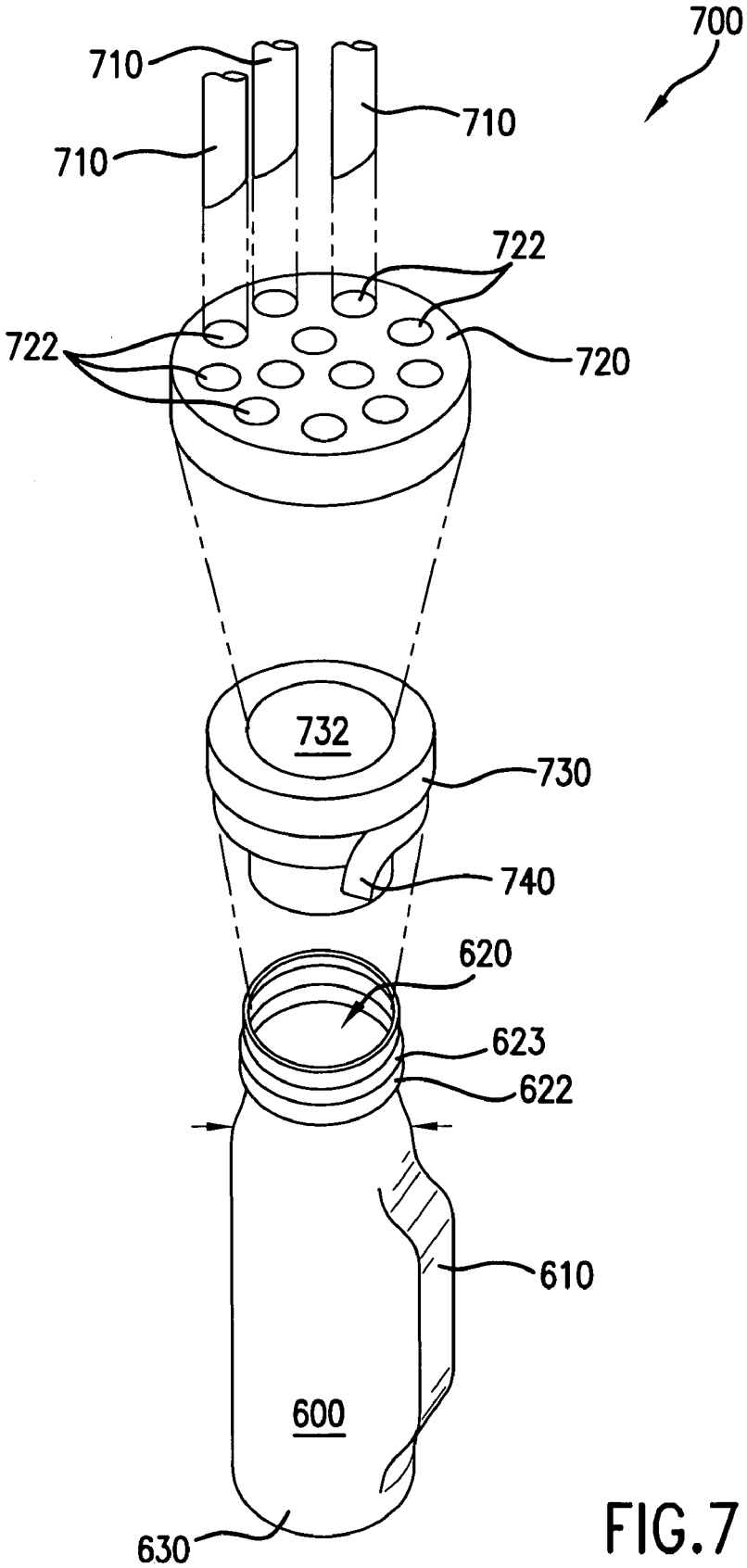
FIG. 7 is a perspective exploded view of a shipping assembly incorporating the container of FIGS. 6*a–c*.

A packaged horticultural product 700 incorporating the container 600 is illustrated in FIG. 7. The product 700 is preferably fitted together in the following manner. First, one or more stems 710 are inserted into corresponding holes 722 in a foam block 720. The foam block may be of any of the types illustrated in FIGS. 1*a,b,c* and FIG. 2.

When all of the stems 710 have been inserted into the block 720, and any holes 722 in which no stem 710 has been placed have been plugged, the block 720 is inserted into an opening 732 in cap 730. The opening is sized such that foam block 720 is compressed by an amount in the ranges discussed above.

Next, one or more side walls of the container 600 are depressed inward and, while the one or more side walls are depressed, the cap 730 is inserted into the open top 620 of container 600. Depressing the side walls a small amount prior to insertion of the cap helps to prevent and/or minimize the amount of back pressure that is created when the cap 730 is pressed into place over the open top 620. That is, when the force creating the depressions on the side walls is removed, the side walls return to their original position and the volume inside the container is increased, thereby providing additional room for the expansion of any air compressed as a result of placing the cap 730 on the top 620.

The cap 730 is securely held in place over the open top 620 by a tear away strip 740 of the type that is commonly used on consumer beverage containers, especially plastic milk containers. Ridges 622, 623 formed around the circumference of the open top 620 aid in the formation of a mechanical bond between the top 620 and the cap 730 and tear away strip 740, respectively. When the consumer wishes to remove the stems 710 from the product 700, the tear-away strip 740 is torn away and the cap 730 is then removed from the top 620. The consumer can then push the foam block 700 upward out of the cap 730 so that the block 720 decompresses. At that point, the stems 710 can be removed from the foam block 700.

Figure 8A:
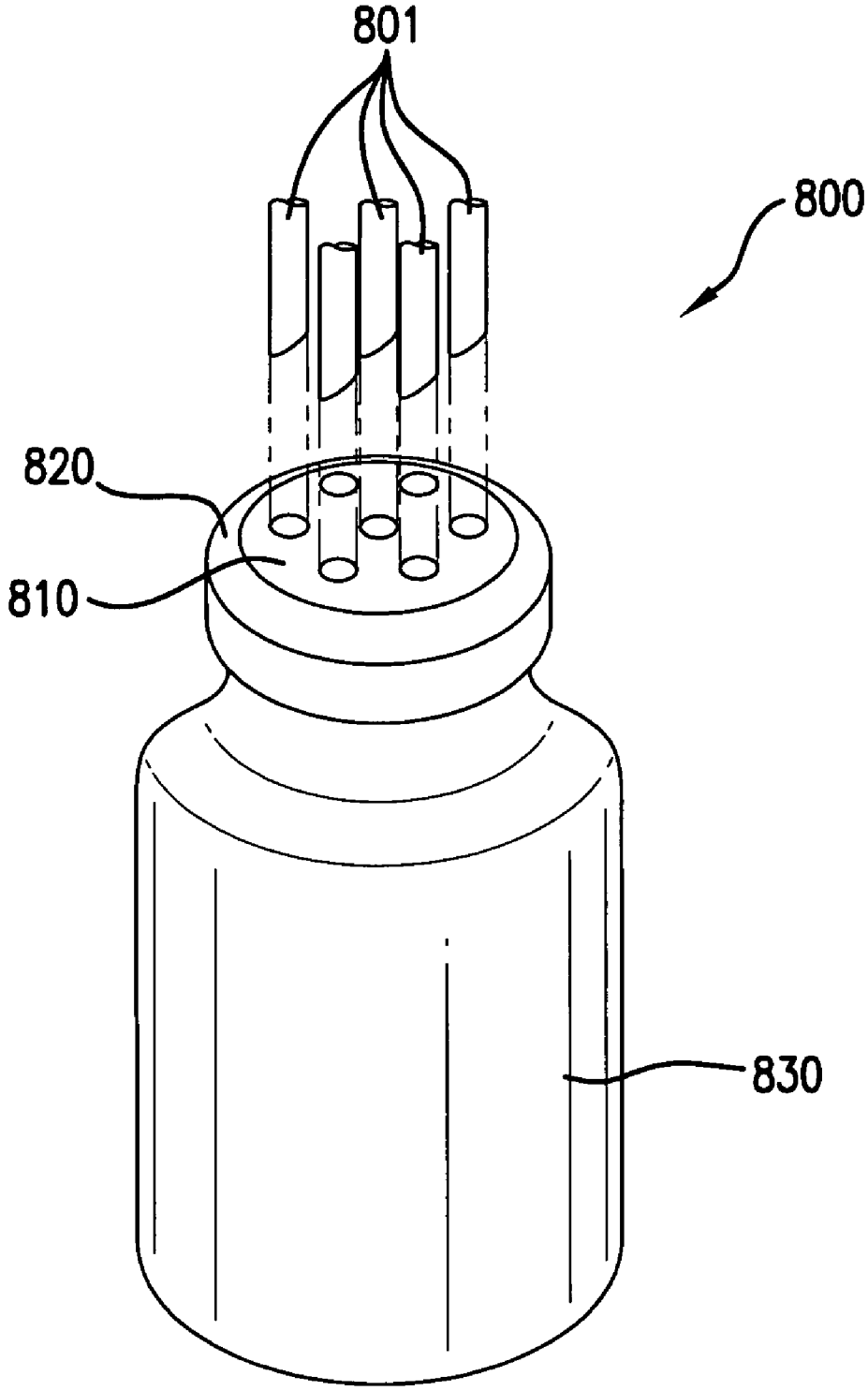
FIG. 8*a* is a perspective view of a packaged horticultural product according to yet another embodiment of the invention.

FIG. 8*a* illustrates a packaged horticultural product 800 according to yet another embodiment of the invention. The product 800 includes a foam block 810 through which a plurality of flower stems 801 (shown in phantom in FIG. 8*a*) have been inserted. The foam block 810 is held in place by a cap 820, which is attached to a container 830.

Figure 8B:
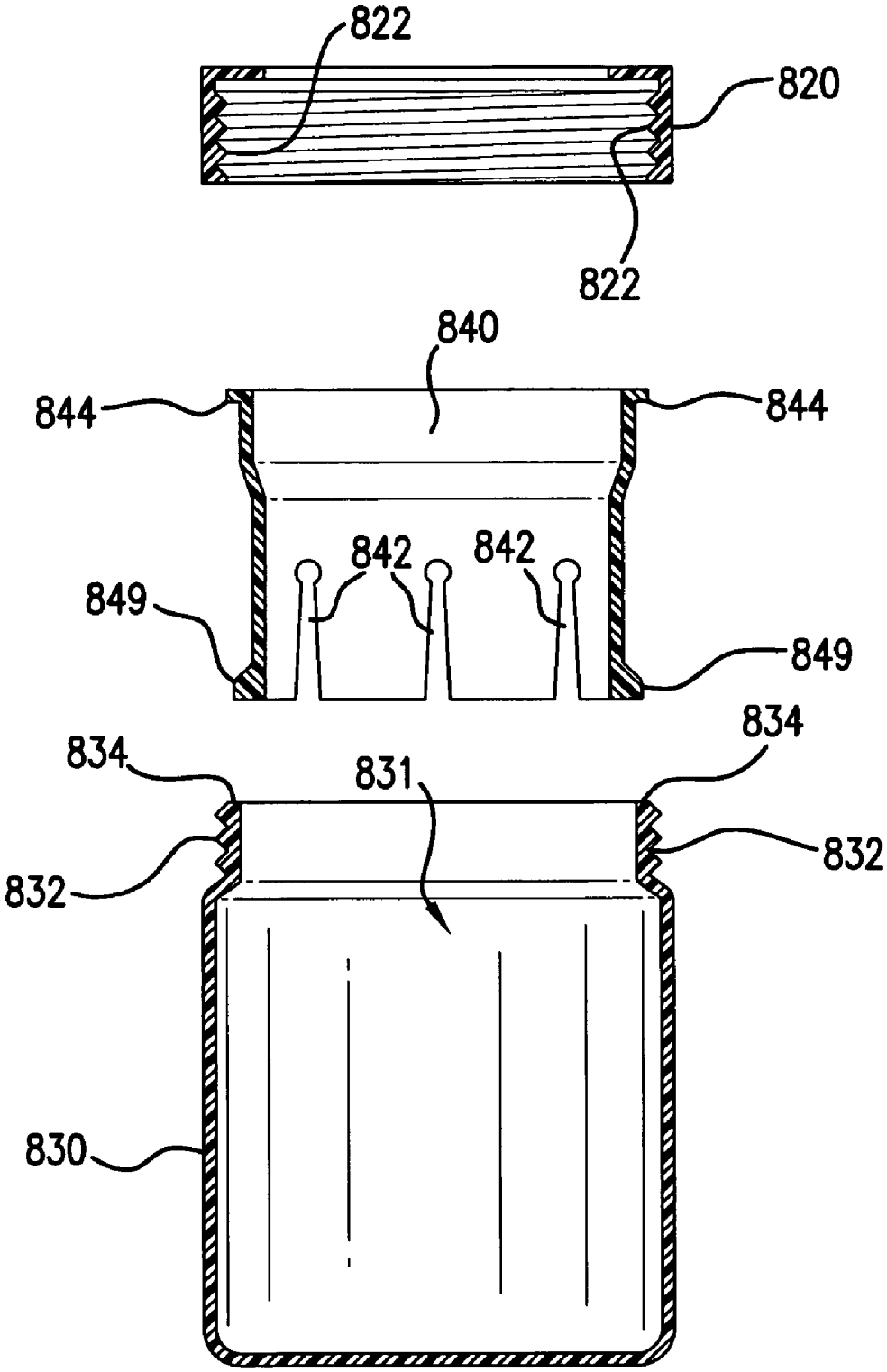
FIG. 8*b* is a side cross-sectional view of portions of the product of FIG. 8*a*.

Referring now to FIG. 8*b*, the cap 820 includes a threaded surface 822 that mates with a corresponding threaded surface 832 of an opening 831 of container 830. The cap holds an insert 840 (into which the foam block 810, not shown in FIG. 8*b*, is inserted) in place in the container opening 831. The insert 840 includes a lip 844 that rests on an upper surface 834 of the opening 831. The insert, which is preferably formed of a flexible plastic, includes a plurality of slits 842. The slits 842 allow the portion of the insert 841 between the lists to flex, which facilitates the insertion of the foam block 810. A band (not shown in FIG. 8*b*; preferably similar to the band 320 discussed above in connection with FIG. 3) is installed around the portion of the insert 841 in the area of the slits 842 to compress the foam block. The lip 849 on the insert 841 hold the band in place.

Although the rigid containers of the embodiments of the invention illustrated in FIGS. 4–8 include removable caps, other embodiments of the invention use rigid containers that do not include any removable cap. In such embodiments, the foam block is placed directly into an opening of the container. The container may be a glass vase in such embodiments.

Figure 9B:
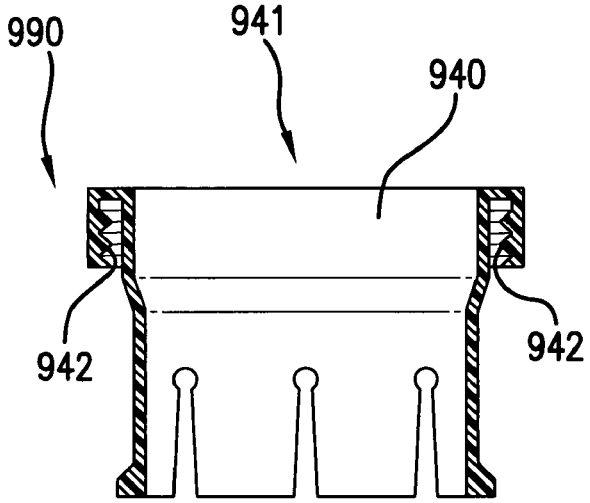
FIGS. 9*a* and 9*b* are a side cross sectional view and a side view, respectively, of portions of an alternative container for a packaged horticultural product according to yet another embodiment of the invention.
Figure 9B:
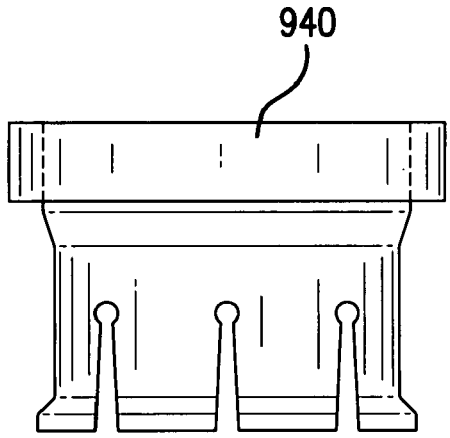
Figure 9A:
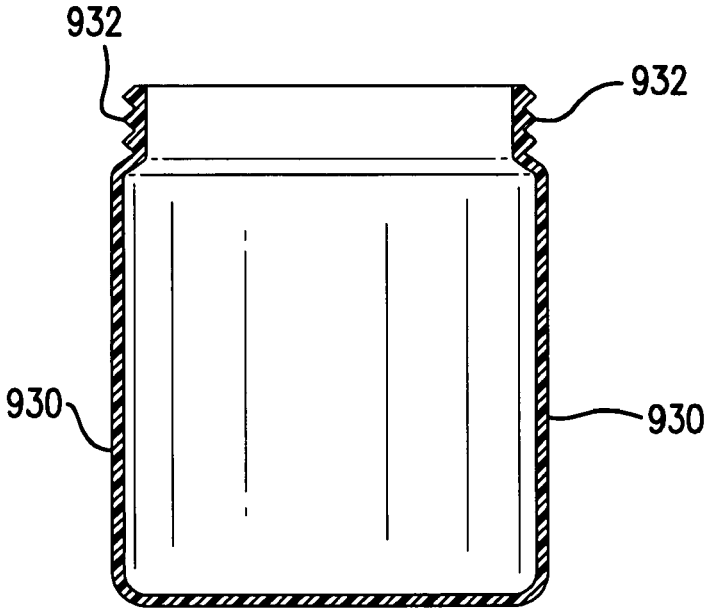

FIG. 9 illustrates an alternative assembly 990 that includes a container 930 with a threaded surface 932 that mates with a corresponding threaded surface 942 of a combination cap/insert 940. A foam block (not shown in FIG. 9) is inserted into the opening 941 of the insert 940 and held in place with a band (not shown in FIG. 9) as discussed above in connection with FIG. 8*b*. When the cap/insert 940 is screwed onto the container 930, the cap/insert 940 and the foam block disposed therein are held in place on the container 930.

Figure 10A:
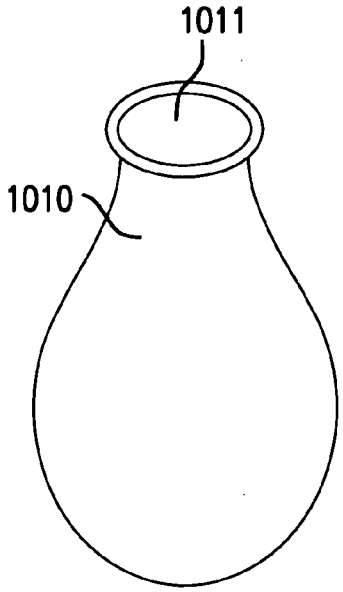
FIGS. 10*a–c* are perspective view of a packaged horticultural product according to yet another embodiment of the invention.
Figure 10C:
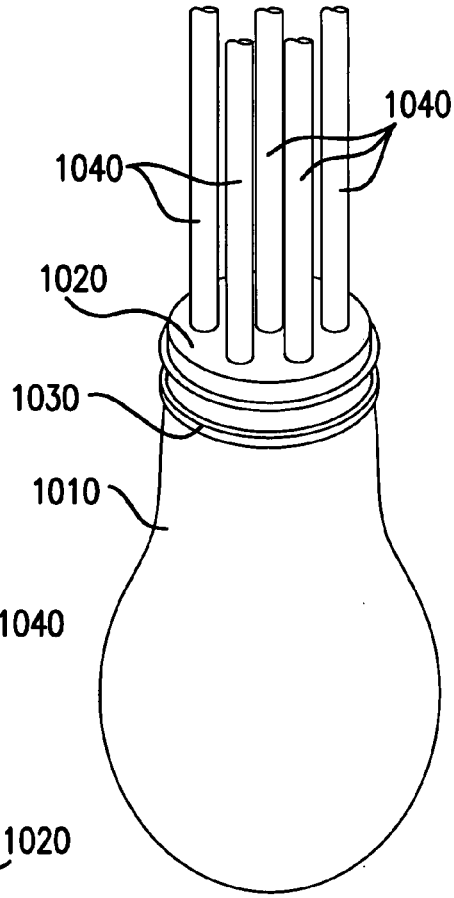
Figure 10B:
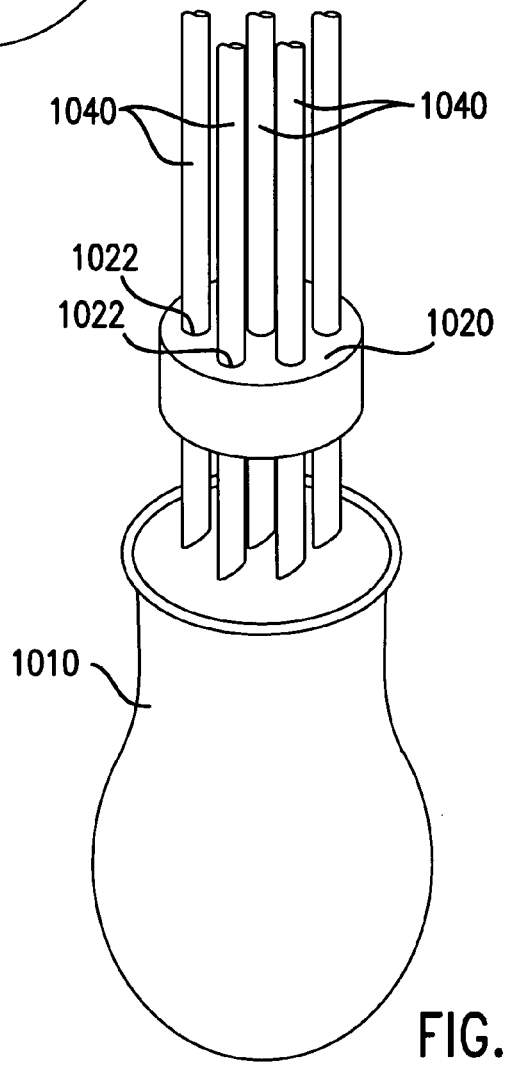

FIGS. 10*a*–*c* illustrates a latex bag (sometimes referred to as a stuffing balloon) 10110 that may be used in place of the bag 310 of FIG. 3. The bag 1010 is comprised of latex that will flex and stretch. This allows the bag 1010 to expand with changes in atmospheric pressure such as those encountered in an airplane cargo hold, thereby relieving pressure exerted on the foam block 1020 by air inside the bag 1010 under such conditions. More importantly, however, the use of a flexible bag 1010 allows the bag to conform to any available space in a shipping container. This is very important in situations in which a plurality of packaged horticultural products are shipped in a common container as it minimizes the volume required for the common container, which reduces shipping costs.

The mouth 1011 of the bag may be pulled open as shown in FIG. 10*b* by vacuum equipment (or other equipment known in the art) so that a foam block 1020 may be inserted therein. A plurality of stems 1040 are inserted into corresponding openings 1022 in the foam block 1020 prior to insertion of the foam block into the mouth 1011 of the bag 1011. After the foam block 1020 has been inserted, a band 1030 (which may be similar to the band 320 of FIG. 3) placed around the outside of the mouth 1011 is used to compress the foam block 1020 as shown in FIG. 10*c*.

In each of the embodiments shown above, stems may be placed in each of the openings of the foam blocks. Alternatively, one or more of the openings may be filled by a plug (not shown in the figures).

Figure 11A:
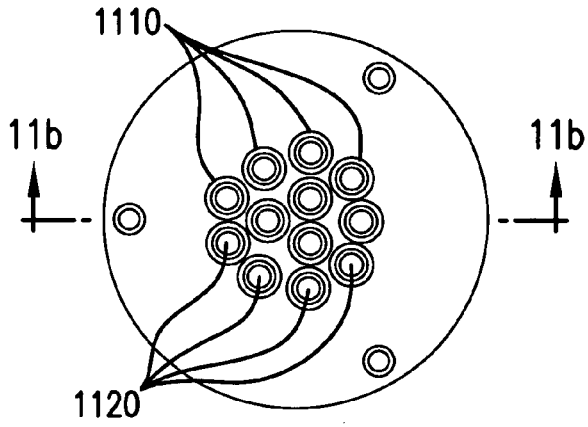
FIGS. 11*a–c* are top, side cross sectional and perspective views, respectively, of a device for inserting stems into foam block according to still another embodiment of the invention.
Figure 11C:
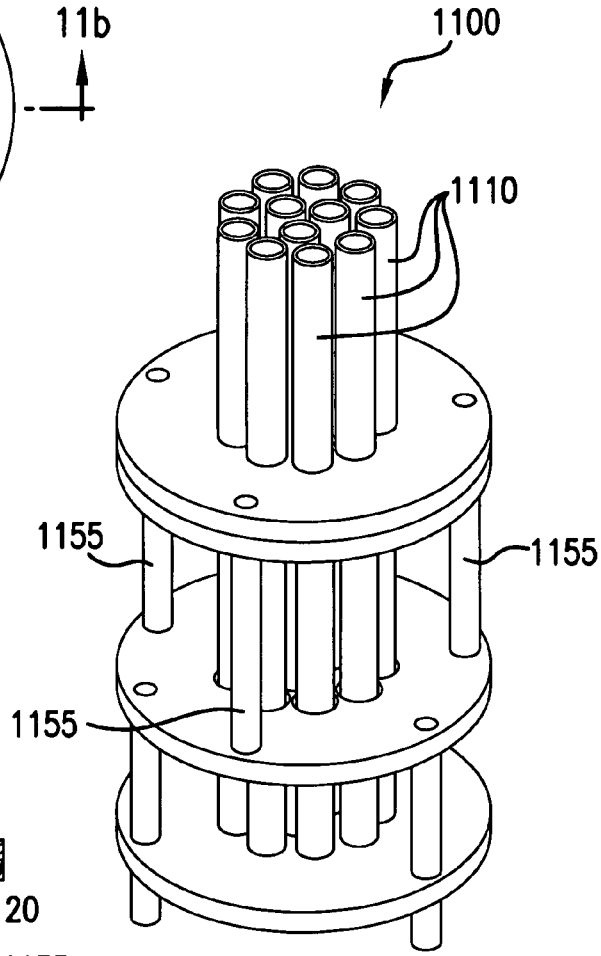
Figure 11B:
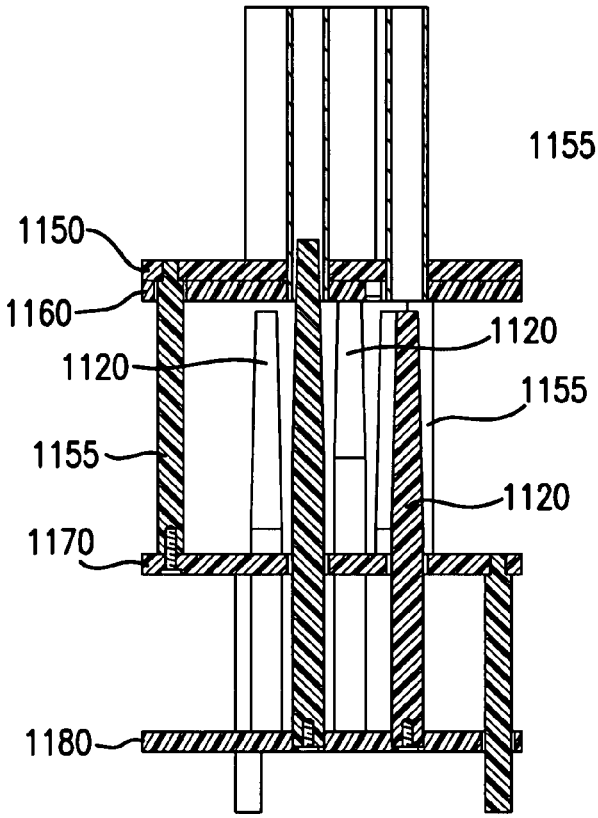

As discussed above, some embodiments of the invention utilize foam blocks with passages that are stretched apart by fulfillment equipment prior to the insertion of stems therethrough. An exemplary fulfillment device 1100 is illustrated in FIG. 11. The device includes a plurality of upstanding tubes 1110 with positions that correspond to holes in a foam block (such as the holes 110 of FIG. 1). Each of the tubes 1110 has a slightly larger diameter than the corresponding hole of the foam block. Each of the tubes 1110 has a corresponding finger 1120 disposed therein. The device 1100 also includes four stages 1150, 1160, 1170, 1180 that are movable with respect to each other, except that stages 1150 and 1170 are always separated by supports 1155.

Figure 12:
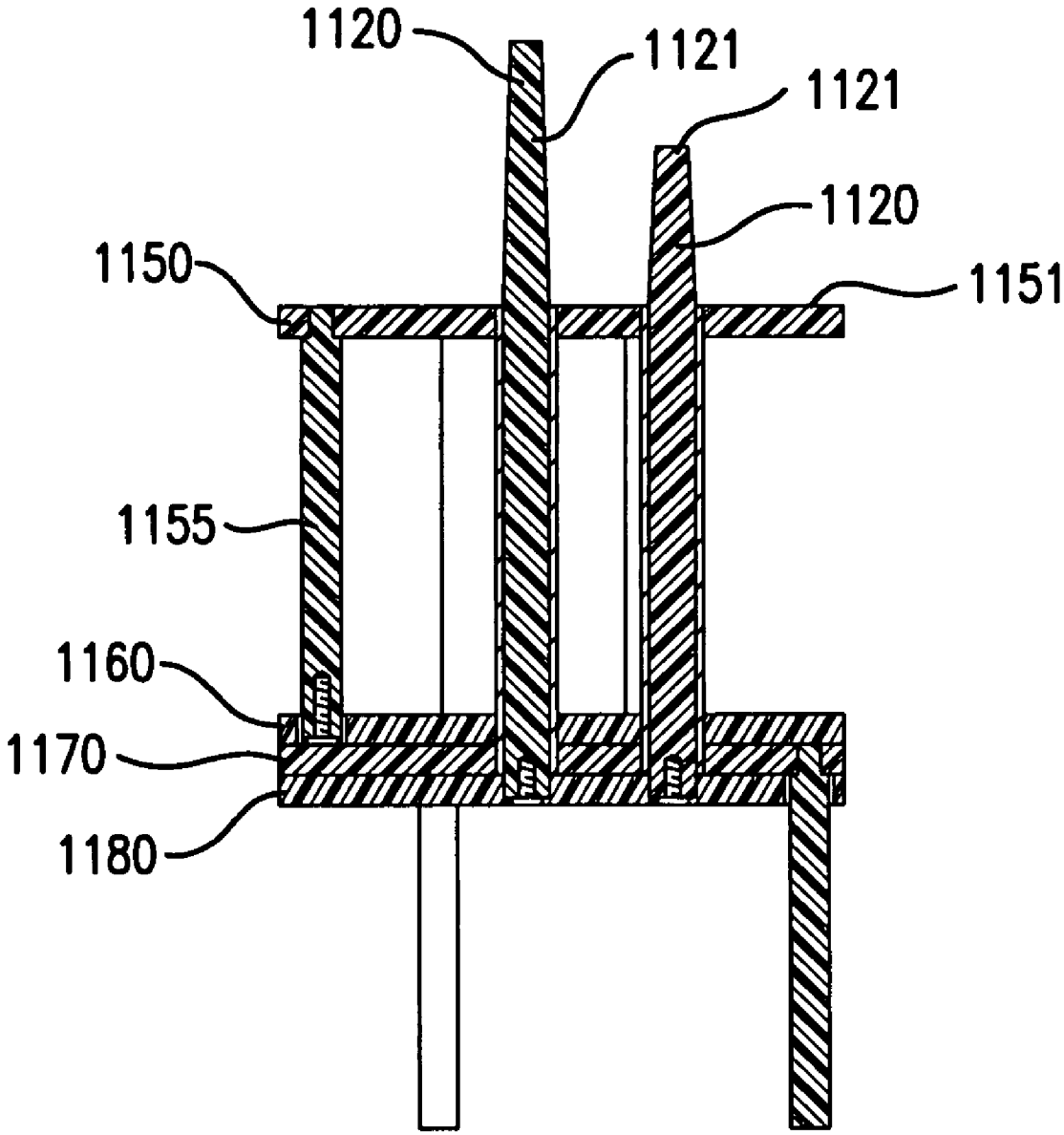
FIG. 12 is a side cross sectional view of the device of FIG. 11 in a second position.
Figure 13A:
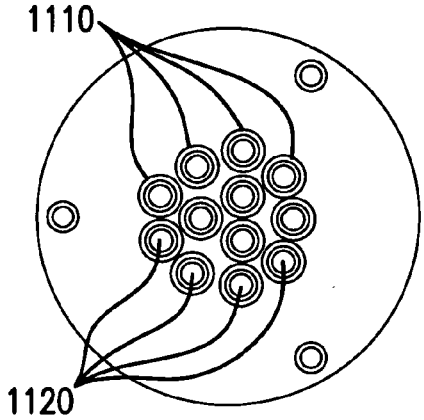
FIGS. 13*a–c* are top, side cross sectional and perspective views, respectively, of the device of FIG. 11 in a third position.
Figure 13C:
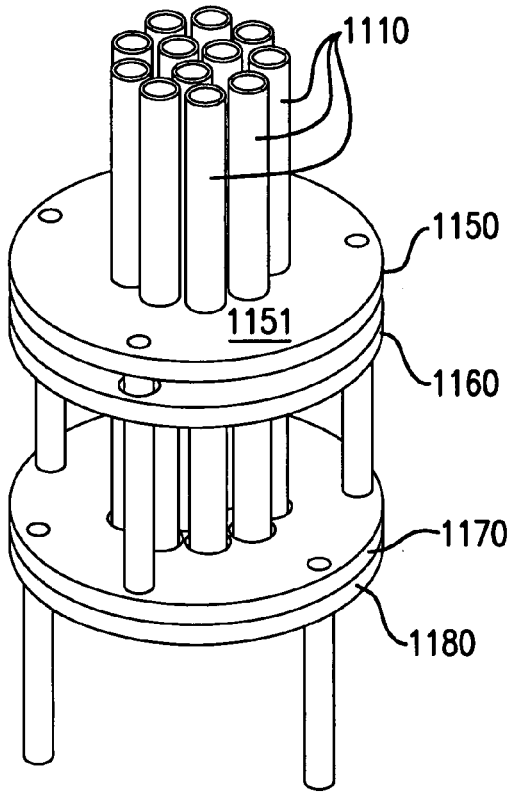
Figure 13B:
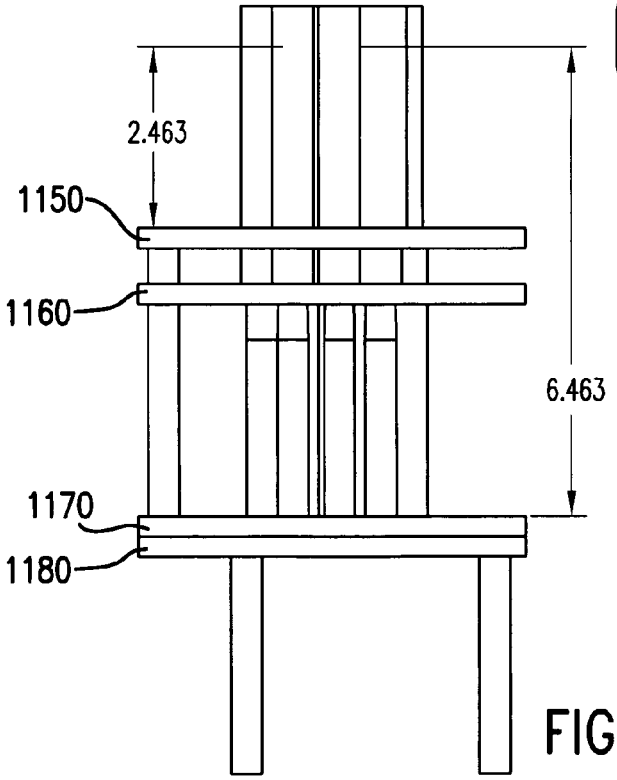

The fulfillment device 1100 is used as follows. First, the stages are manipulated as shown in FIG. 12 such that stages 1160, 1170 and 1180 are contiguous to each other. This results in the upper edge of tubes 110 being even with a top edge 1151 of stage 1150 and the upper portions 1121 of fingers 1120 extending above stage 1150. The upper portions 1121 of the fingers are tapered such that they are narrower than the holes in a foam block (not shown in FIG. 13) with which the device 1100 is used. At this point, the foam block is set in place over stage 1150 such that the fingers 1120 are within the corresponding holes. Next, stage 1160 is moved toward stage 1150 such that the tubes 1110 extend beyond the upper surface 1151 of stage 1150 as shown in FIG. 13. In this position, they are inserted into and stretch a corresponding hole of a foam block. Next, stage 1180 is moved away from stage 1170 as shown in FIG. 11 such that most or all of the tubes 1110 are empty and can accept a flower stem. After flower stems have been inserted into each of the tubes 110, the tubes 1110 are removed from the foam block. This allows the holes in the foam block to close around the stems and the foam block is ready for compression.

Figure 14:
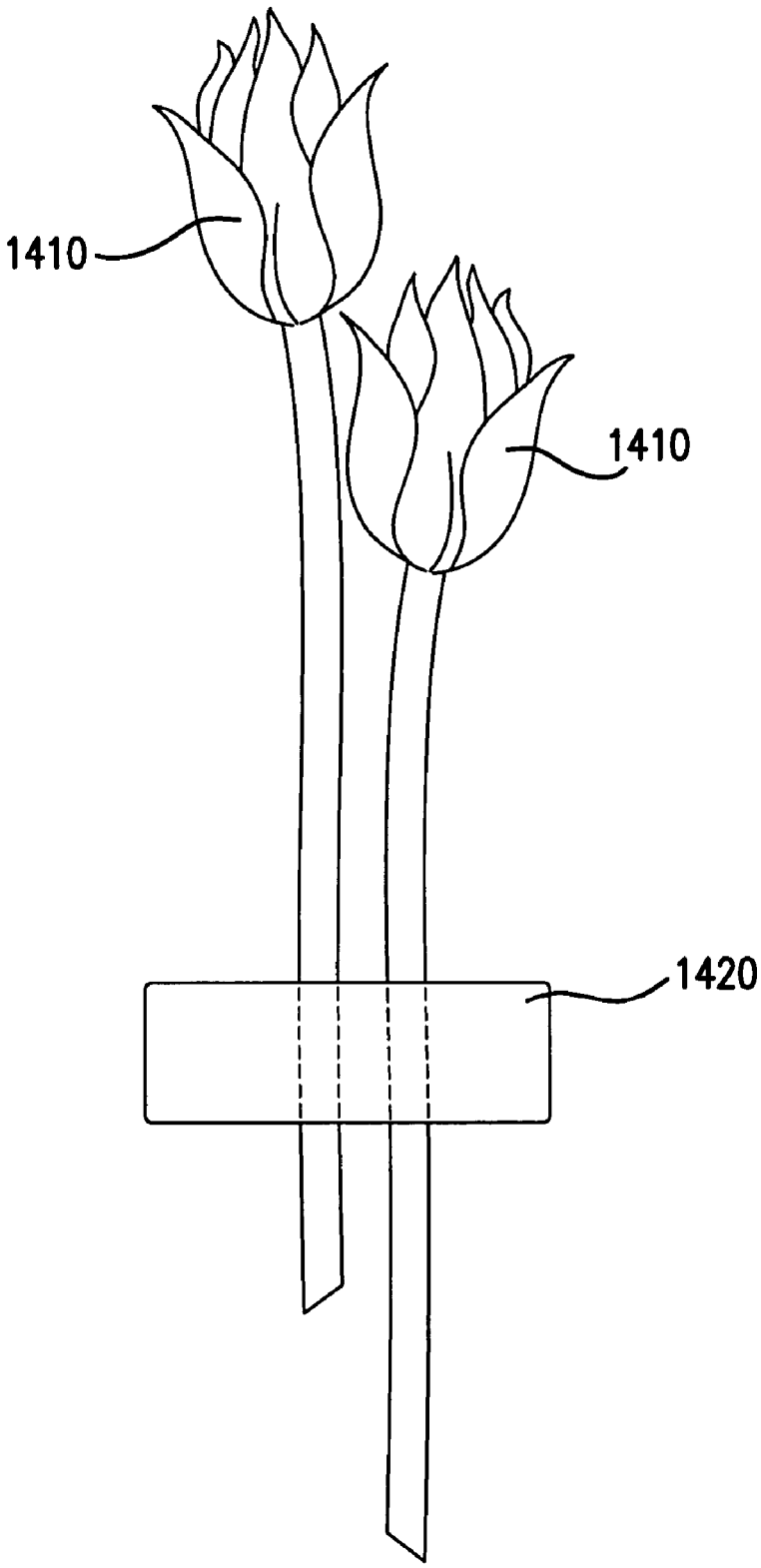
FIG. 14 is a side view of a portion of a bouquet of cut flowers arranged in a staggered presentation using the device of FIG. 11.

Because the fingers 1120 are of differing heights, flower stems are positioned in the foam block such that they are at different depths. Thus, the fulfillment device 1100 allows stems of cut flowers 1410, to be inserted through a foam block 1420 by varying amounts, which allows a plurality of equal-length cut flowers 1410 to be staggered in the manner illustrated in FIG. 14. This is important because staggering the flowers reduces the size of a packaged horticultural product, which reduces shipping costs. In the prior art, staggering was accomplished by arranging the heads of cut flowers in a staggered pattern, and then cutting all of the stems evenly. This sacrifices the length of some of the stems, with the result that the individual stems of the flowers in the bouquet are of unequal length.

Figure 15:
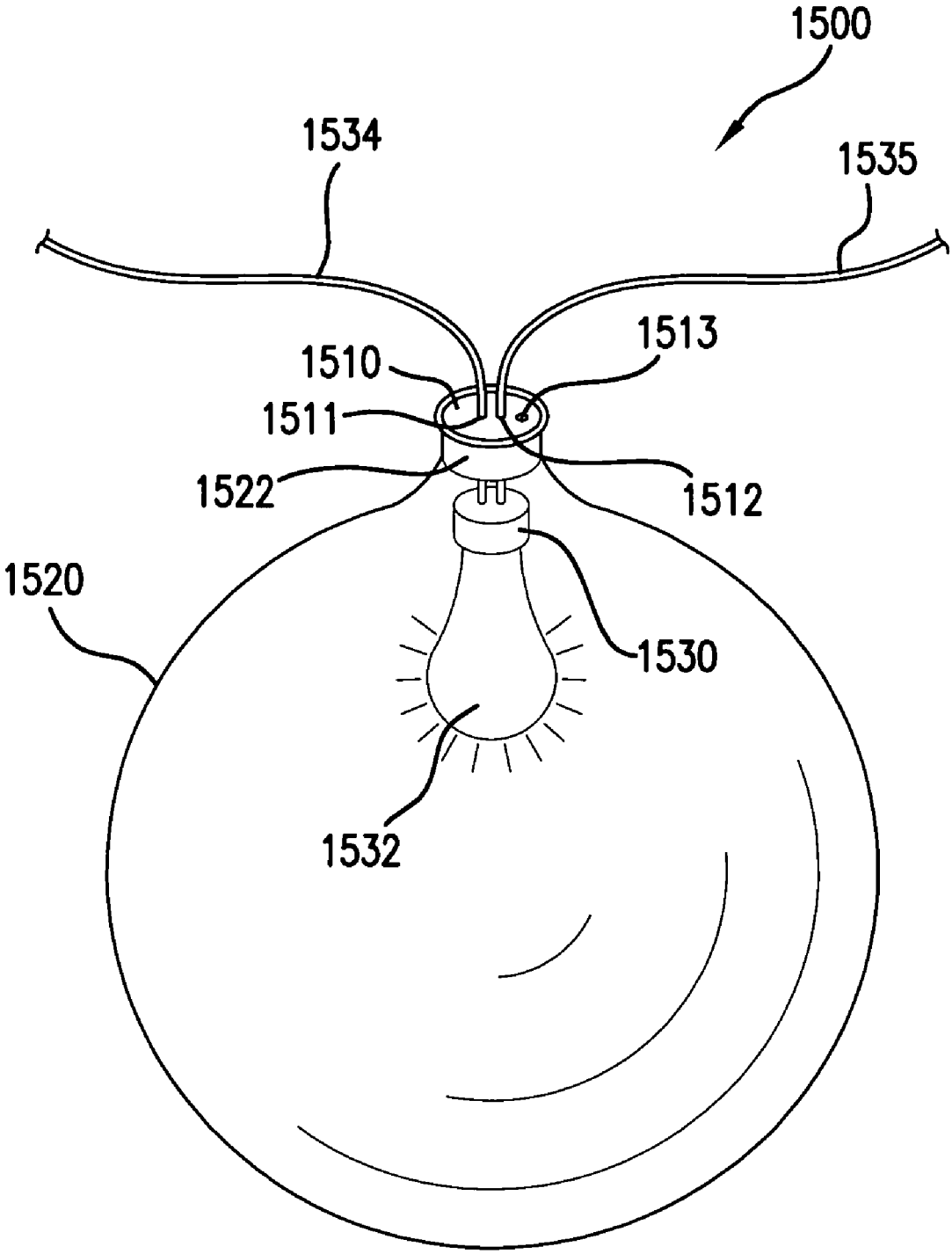
FIG. 15 is a perspective view of a light bulb disposed within a ballon according to still another embodiment of the invention.

FIG. 15 is a perspective view of the use of a foam block 1210 with an inflatable balloon 1520 to form a decorative light fixture 1500. The foam block 1510 includes two passages 1511, 1512 through which pass wires 1534, 1535 for a light socket 1530 holding a light bulb 1532 disposed inside of the balloon 1520. A third passage 1513 is provided in the foam block 1510 to allow for a needle (not shown in FIG. 15) to be inserted through the foam block 1510 to inflate the balloon 1520 (a plug is disposed in passage 1513 to prevent air from escaping after a filling operation). A band 1522 (similar to the band 320 of FIG. 3) is placed around the mouth of the balloon 1520 to compress the foam block 1510 so that air in the balloon 1520 does not escape. A plurality of light fixtures 1500 may be strung together in the manner of party lanterns.

Preferably, flowers are placed in the shipping assemblies of the present invention as soon as possible after they are cut in order to extend their life as long as possible. In some embodiments of the invention, the flowers are packaged at the grower's location and shipped directly to a consumer, preferably via a common carrier such as UPS or FEDEX. Alternatively, the flowers may be shipped to a retail location, where they can be displayed and sold while still in the packaging. This is particularly advantageous for retail establishments that desire to sell flowers but do not have the staff to repackage received flowers for retail sale. In such embodiments, the container (whether rigid or soft) preferably holds enough water such that the retail establishment does not have to add water to the container before it is sold to the consumer.

It should also be understood that the present invention is not limited to use with water and may be used with liquids of various viscosities, including liquids with viscosities approximately equal to that of water as well as liquids such as gels with higher viscosities. Such liquids may or may not contain plant nutrients or other substances.

Obviously, numerous modifications and variations of the present invention are possible in light of the above teachings. It is therefore to be understood that within the scope of the appended claims, the invention may be practiced otherwise than as specifically described herein.

What is claimed is:

1. A method for packaging a horticultural product comprising the steps of:

inserting a stem of the horticultural product into a passage formed in a foam block, the foam block comprising a foam and having a density between 0.5 and 10 pounds per cubic foot (PCF) and a compression force/deflection (CFD) between 0.5 and 10 pounds per square inch (PSI);

at least partially filling a container with a liquid, the container having an opening, the container being flexible;

disposing the foam block in the opening of the container such that a bottom of the stem is submerged in the liquid; and compressing the foam block using a band surrounding the foam block and a portion of the container adjacent the foam block such that the foam block forms a watertight seal between the opening of the container and the stem;

wherein the stem can take up the liquid.

2. The method of claim 1, wherein the foam block includes a plurality of passages formed therein, and wherein a stem is disposed in each of the passages such that each stem of each horticultural product is insulated from each other stem.

3. The method of claim 1, wherein the foam block is compressed such that a cross sectional area of the foam block adjacent the band is reduced by at least 28% relative to a cross sectional area of the foam block in an uncompressed state.

4. The method of claim 1, wherein the foam block is compressed such that a cross sectional area of the foam block adjacent the band is reduced by at least 36% and no more than 84% relative to a cross sectional area of the foam block in an uncompressed state.

5. The method of claim 1, wherein the foam in the foam block is compressed such that a cross sectional area of the foam block adjacent the band is reduced by at least 33% relative to a cross sectional area of the foam block in an uncompressed state.

6. The method of claim 1, wherein the foam in the foam block is compressed such that a cross sectional area of the foam block adjacent the band is reduced by at least 42% and no more than 98.7% relative to a cross sectional area of the foam block in an uncompressed state.

7. The method of claim 1, wherein the foam block is a rubber-based foam.

8. The method of claim 7, wherein the rubber-based foam is a vinyl nitrile foam.

9. The method of claim 1, wherein the foam block is polyethylene-based foam.

10. The method of claim 1, wherein the foam block is polyurethane-based foam.

11. The method of claim 1, wherein the foam block has a circular cross sectional shape.

12. The method of claim 1, wherein the container is a flexible bag.

13. The method of claim 1, wherein the liquid comprises water.

14. The method of claim 1, wherein the liquid consists essentially of water.

15. The method of claim 1, wherein the stem extends past a lower surface of the foam block.

16. A packaged horticultural product comprising:

a flexible container at least partially filled with a liquid, the container having an opening;

a foam block disposed in the opening, the foam block having at least one passage formed therein, the foam block comprising a foam, the foam having a density between 0.5 and 10 PCF and a CFD between 0.5 and 10 pounds per square inch (PSI);

at least one horticultural product having a stem, the stem being disposed in the at least one passage such that an end of the stem is exposed to the liquid; and a tensioned band surrounding the foam block and a portion of the container adjacent to the foam block such that the tensioned band compresses the foam block;

wherein the foam block forms a watertight seal between the stem and opening of the container.

17. The product of claim 16, further comprising a plurality of horticultural products, wherein the foam block has a plurality of passages formed therein, and wherein a single stem is disposed in each of the passages in the foam block such that each stem of each horticultural product is insulated from each other stem.

18. The product of claim 16, wherein the foam block is compressed such that a cross sectional area of the foam block adjacent the tensioned band is reduced by at least 28% relative to a cross sectional area of the foam block in an uncompressed state.

19. The product of claim 16, wherein the foam block is compressed such that a cross sectional area of the foam block adjacent the tensioned band is reduced by at least 36% and no more than 84% relative to a cross sectional area of the foam block in an uncompressed state.

20. The product of claim 16, wherein the foam in the foam block is compressed such that a cross sectional area of the foam block adjacent the tensioned band is reduced by at least 33% relative to a cross sectional area of the foam block in an uncompressed state.

21. The product of claim 16, wherein the foam in the foam block is compressed such that a cross sectional area of the foam block adjacent the tensioned band is reduced by at least 42% and no more than 98.7% relative to a cross sectional area of the foam block in an uncompressed state.

22. The product of claim 16, wherein the foam block is a rubber-based foam.

23. The product of claim 22, wherein the rubber-based foam is a vinyl nitrile foam.

24. The product of claim 16, wherein the foam block is polyethylene-based foam.

25. The product of claim 16, wherein the foam block is polyurethane-based foam.

26. The product of claim 16, wherein the foam block is composed of a vinyl nitrile material.

27. The product of claim 16, wherein the foam block has a circular cross sectional shape.

28. The product of claim 16, wherein the liquid comprises water.

29. The product of claim 16, wherein the liquid consists essentially of water.

30. The product of claim 16, wherein the stem extends through the at least one passage and an end of the stem is submerged in the liquid.

31. A method for preparing a packaged horticultural product comprising the steps of:

inserting a stem of the horticultural product into a passage formed in a foam block at least partially filling a container with a liquid, the container having an opening;

placing the foam block in the opening of the container; and compressing the foam block such that a cross sectional area of the foam block is reduced by at least 28% relative to a cross sectional area of the foam block in an uncompressed state and the foam block forms a watertight seal between the stem and the opening, and such that a bottom of the stem is exposed to the liquid so that the stem can take up the liquid.

32. The method of claim 31, wherein the foam block includes a plurality of passages formed therein, and wherein a stem is disposed in each of the passages such that each stem of each horticultural product is insulated from each other stem.

33. The method of claim 31, wherein the foam is compressed such that a cross sectional area of the foam block is reduced by at least 36% and no more than 84% relative to a cross sectional area of the foam block in an uncompressed state.

34. The method of claim 31, wherein the foam in the foam block is compressed such that a cross sectional area of the foam block is reduced by at least 33% relative to a cross sectional area of the foam block in an uncompressed state.

35. The method of claim 31, wherein the foam in the foam block is compressed such that a cross sectional area of the foam block is reduced between 42% and 98.7% relative to a cross sectional area of the foam block in an uncompressed state.

36. The method of claim 31, wherein the foam block is a rubber-based foam.

37. The method of claim 36, wherein the rubber-based foam is a vinyl nitrile foam.

38. The method of claim 31, wherein the foam block is polyethylene-based foam.

39. The method of claim 31, wherein the foam block is polyurethane-based foam.

40. The method of claim 31, wherein the container is rigid.

41. The method of claim 31, wherein the container is flexible and wherein the foam block is compressed by a band placed around the foam block and a portion of the container adjacent the foam block.

42. The method of claim 31, wherein the stem extends past a lower surface of the foam block and the bottom of the stem is submerged in the liquid.

43. A packaged horticultural product comprising:

a container at least partially filled with a liquid, the container having an opening;

a foam block disposed in the opening, the foam block having at least one passage formed therein, the foam block comprising a foam, the foam block being compressed such that a cross sectional area of the foam is reduced by at least 28% relative to a corresponding cross sectional area of the foam in an uncompressed state; and at least one horticultural product having a stem, the stem being placed in the at least one passage such that an end of the stem is exposed to the liquid; wherein the foam block forms a watertight seal around the stem such that water cannot escape from the container.

44. The product of claim 43, further comprising a plurality of horticultural products, wherein the foam block includes a plurality of passages formed therein, and wherein a single stem is disposed in each of the passages in the foam block such that each stem of each horticultural product is insulated from each other stem.

45. The product of claim 43, wherein the foam block is compressed such that a cross sectional area of the foam is reduced by at least 36% and not more than 84% relative to a corresponding cross sectional area of the foam in an uncompressed state.

46. The product of claim 43, wherein the foam is compressed such that a cross sectional area of the foam is reduced by at least 56% and not more than 80% relative to a corresponding cross sectional area of the foam in an uncompressed state.

47. The product of claim 46, wherein the foam in the foam block is compressed such that a cross sectional area of the foam is reduced by at least 33% relative to a corresponding cross sectional area of the foam in an uncompressed state.

48. The product of claim 46, wherein the foam in the foam block is compressed such that a cross sectional area of the foam is reduced between 42% and 98.7% relative to a corresponding cross sectional area of the foam in an uncompressed state.

49. The product of claim 46, wherein the foam block is a rubber-based foam.

50. The product of claim 46, wherein the rubber-based foam is a vinyl nitrile foam.

51. The product of claim 46, wherein the foam block is polyethylene-based foam.

52. The product of claim 46, wherein the foam block is polyurethane-based foam.

53. The product of claim 46, wherein the container is rigid.

54. The product of claim 46, wherein the container is flexible.

55. The product of claim 43, wherein the liquid has a viscosity approximately equal to water.

56. The product of claim 43, wherein the liquid consists essentially of water.

57. The product of claim 43, wherein a bottom of the stem extends past a lower surface of the foam block and is submerged in the liquid.

58. A package for a horticultural product comprising:

a flexible bag capable of being at least partially filled with a liquid, the flexible bag having an opening; and a foam block disposed in the opening, the foam block having at least one passage formed therein, the foam block comprising a foam, the foam block having a density between 0.5 and 10 PCF and a CFD between 0.5 and 10 pounds per square inch (PSI), the passage being sized to accept at least one horticultural product having a stem;

wherein the foam block forms a watertight seal between the stem and opening of the flexible bag when the stem is inserted into the passage.

59. A package for a horticultural product comprising:

a container capable of being at least partially filled with a liquid, the container having an opening; and a foam block disposed in the opening, the foam block having at least one passage formed therein, the foam block comprising a foam, the foam block being compressed by at least 28%, the passage being sized to accept at least one horticultural product having a stem, the foam block forming a watertight seal around the stem and the opening of the container such that liquid is prevented from escaping from the container.

60. A method for packaging a horticultural product comprising the steps of:

inserting a stem of the horticultural product into a passage formed in a pre-formed foam block, the pre-formed foam block comprising a foam and having a density between 0.5 and 10 pounds per cubic foot (PCF) and a compression force/deflection (CFD) between 0.5 and 10 pounds per square inch (PSI);

filling a container at least partially with a liquid, the container having an opening; and disposing the pre-formed foam block in the opening of the container such that the pre-formed foam block is under compression and a bottom of the stem is submerged in the liquid such that the stem can take up the liquid;

wherein the pre-formed foam block forms a watertight seal between the opening of the container and the stem and the pre-formed block is formed prior to the disposing step.

61. The method of claim 60, wherein the pre-formed foam block is compressed such that a cross sectional area of the pre-formed foam block adjacent the opening is reduced by at least 28%.

62. The method of claim 60, wherein the pre-formed foam block is compressed such that a cross sectional area of the pre-formed foam block adjacent the opening is reduced by at least 36% and no more than 84%.

63. The method of claim 60, wherein the liquid consists essentially of water.

64. The method of claim 60, wherein the pre-formed foam block comprises polyurethane-based foam.

65. The method of claim 60, wherein the container is flexible and the pre-formed foam block is compressed by tightening a band around the pre-formed foam block and a portion of the container adjacent to the foam block.

66. The method of claim 65, wherein the container is a flexible bag.

67. The method of claim 60, wherein the container is rigid and the opening of the container is smaller than the pre-formed foam block, and the pre-formed foam block is compressed as a result of being disposed in the opening.

68. The method of claim 67, wherein the container includes a removable cap in which the opening is located.

69. The method of claim 68, wherein the foam block is placed in the opening of the removable cap before the removable cap is placed on the container.

70. A packaged horticultural product comprising:

a container at least partially filled with a liquid, the container having an opening;

a foam block disposed in the opening, the foam block having at least one passage formed therein, the foam block comprising a foam, the foam having a density between 0.5 and 10 PCF and a CFD between 0.5 and 10 pounds per square inch; and at least one horticultural product having a stem, the stem being disposed in the at least one passage such that an end of the stem is exposed to the liquid;

wherein the foam block foams a watertight seal between the stem and opening of the container; and wherein a cross sectional area of the opening of the container is larger than a corresponding cross sectional area of the portion of the foam block disposed in the opening when the foam block is in an uncompressed state.

71. The product of claim 70, wherein the foam block is compressed such that a cross sectional area of a portion of the pre-formed foam block adjacent the opening is reduced by at least 28%.

72. The product of claim 70, wherein the foam block is made from a polyurethane-based foam.

73. The product of claim 70, wherein the foam block has a plurality of passages formed therein.

74. The product of claim 70, wherein the liquid consists essentially of water.

75. The product of claim 70, wherein the container is flexible, and wherein the product further comprises a tensioned band surrounding the foam block and a portion of the container adjacent to the foam block such that the tensioned band compresses the foam block.

76. The product of claim 70, wherein the container is a flexible bag.

77. The product of claim 70, wherein the container is rigid and the opening of the container is smaller than the foam block, and the foam block is compressed as a result of being disposed in the opening.

78. The product of claim 70, wherein the container includes a removable cap in which the opening is located.

* * * * *